US005383562A

United States Patent [19]

Gay

[11] Patent Number: 5,383,562

[45] Date of Patent: Jan. 24, 1995

[54] OPEN FRAME RACK ASSEMBLY

[76] Inventor: Kenneth F. Gay, 241 Apache St., Westerville, Ohio 43081

[21] Appl. No.: 191,040

[22] Filed: Feb. 3, 1994

Related U.S. Application Data

[63] Continuation-in-part of Ser. No. 994,524, Dec. 21, 1992, Pat. No. 5,299,698.

[51] Int. Cl.[6] ..... A47F 5/00

[52] U.S. Cl. ..... 211/181; 108/109; 211/187

[58] Field of Search ..... 211/181, 187, 182, 59.2; 108/107, 109, 111

[56] References Cited

U.S. PATENT DOCUMENTS

| | | | |
|---|---|---|---|
| 2,268,748 | 1/1942 | Glenny | 211/181 |
| 2,868,391 | 1/1959 | Sides | 211/181 |
| 2,919,817 | 1/1960 | Maslow | 211/148 |
| 2,930,486 | 3/1960 | Hoover | 211/44 |
| 3,115,106 | 12/1963 | Gersch | 108/64 |
| 3,208,406 | 9/1965 | Maslow | 108/64 |
| 3,225,720 | 12/1965 | Maslow | 108/64 |
| 3,252,434 | 5/1966 | Young, Jr. | 108/111 |
| 3,435,958 | 4/1969 | Chesley | 211/181 X |
| 3,915,097 | 10/1975 | Young | 211/187 |
| 3,977,529 | 8/1976 | Stroh | 211/187 |
| 4,079,836 | 3/1978 | Von Stein et al. | 206/513 |
| 4,101,148 | 7/1978 | Brown | 211/148 |
| 4,226,190 | 10/1980 | Ashton | 108/11 |
| 4,726,602 | 2/1988 | Sanders et al. | 211/181 X |
| 4,765,495 | 8/1988 | Bisk | 211/181 X |
| 4,978,013 | 12/1990 | Hogg | 211/181 |
| 5,027,959 | 7/1991 | Luukkenen | 211/187 |
| 5,065,873 | 11/1991 | Tseng | 211/187 |
| 5,221,014 | 6/1993 | Welch et al. | 211/187 |
| 5,263,595 | 11/1993 | Hilstolsky | 211/181 X |
| 5,299,698 | 4/1994 | Gay | 211/187 X |

*Primary Examiner*—Robert W. Gibson, Jr.
*Attorney, Agent, or Firm*—Mueller and Smith

[57] ABSTRACT

An open frame rack assembly which is formed of two principal modules having a general U-shape. Two identical such modules are interconnectable and may be assembled in conjunction with a wheel mounting base such that a multi-shelved open frame structure is developed having a tower form of architecture having a stiffness permitting its easy movement upon wheels. The structure is lightweight and may be dimensioned for shipment using lower cost freight facilities.

16 Claims, 12 Drawing Sheets

410
440'
432'
434
536
539
538
452'
452
430'
430
417
540
530
495
453'
453
536
416
538
454'
454
536
415
412
455
455
414
550
434'
548
420
546
552
422
531
536
554
418
432
540
550
546
494
554
421

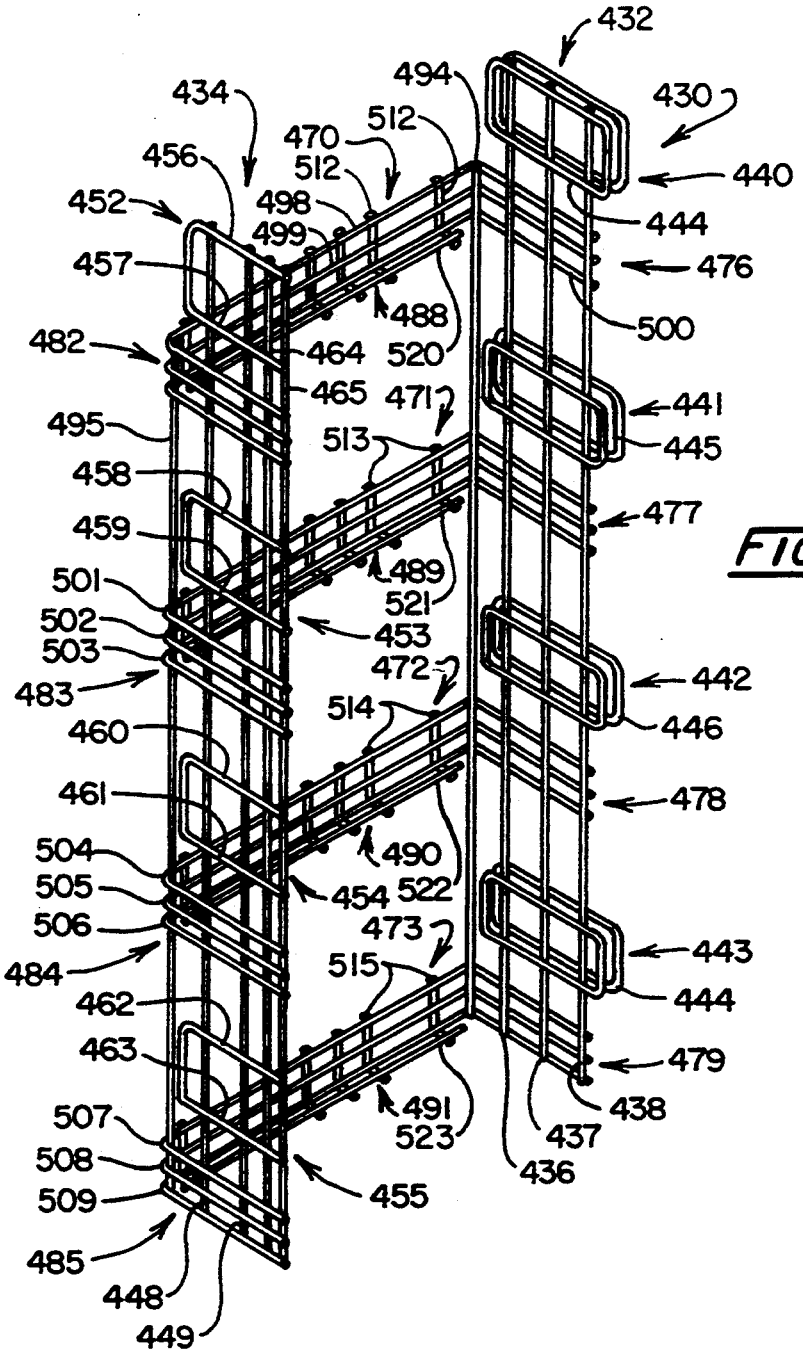
FIG. 16
FIG. 21
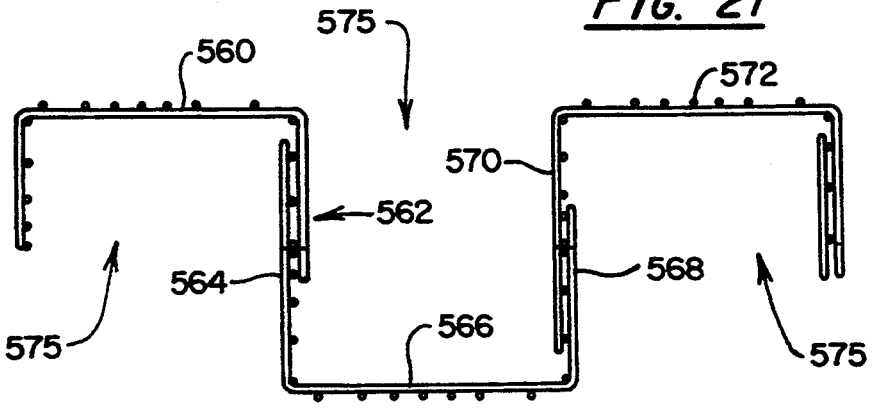

OPEN FRAME RACK ASSEMBLY

CROSS REFERENCE TO RELATED APPLICATIONS

The present application is a continuation-in-part of application for U.S. patent Ser. No. 07/994,524, by Kenneth F. Gay, filed Dec. 21, 1992, entitled "Open Frame Rack Assembly", now U.S. Pat. No. 5,299,698, issued Apr. 5, 1994.

BACKGROUND OF THE INVENTION

The retail merchandising of a broad variety of products involve the use of rack or shelf-based display structures. Very often, the products supported for display, collectively, are relatively heavy. For instance, caulking gun refills, paints, and the like can require customer "reachable" feed forward shelving capable of retaining about 400 pounds worth of merchandise.

In achieving requisite supporting strength, the shelving must be sufficiently "open" to permit the customer to identify varieties of the product, for example, caulking types and paint types, colors and the like. However, requisite strength and openness also must be achieved with a high level of aesthetic quality contributing to a desired ambiance within the retail environment.

Because consumer demands for products generally vary with time and the products displayed by merchants change, merchandising display shelving layouts change periodically. Thus, it is helpful for display component fabricators to have a capability for easily expanding, contracting, or geometrically varying a given display line. Heretofore, typical display shelving for heavier, more robust products have been fabricated of conventional sheet metal configurations connected to uprights. This connection may be carded out, for example, with coupling schemes such as the ubiquitous hook and slot or by bolting. To achieve modularity of sorts, stand alone versions of such shelves are available wherein an "L-shaped" back and foot structure is provided for shelf support. When loaded with goods, resultant forward leaning moment is derived to stabilize the loaded assembly. This form of shelving as well as conventional metal shelving has led to some concern, inasmuch as the customer and children of customers may, from time to time, grasp the forward portion of the display and pull it to tend to tip it over. With conventional steel shelving, however, modularity or fabrication flexibility to meet the changing needs of merchandising with ease has not been effectively realized.

Movable shelving or merchandising racks typically are assembled out of a shipping carton by retail clerks. Such assembly usually involves interconnection of a significant number of components with nuts and bolts in accordance with printed instructions. Very often, such assembly poses an unwanted burden upon the clerks in view of the detail necessarily required of instructions describing bolted assembly. As a consequence, the shelving may not be assembled properly leading to potential hazards at the retail floor.

Sheet metal shelving also exhibits the attributes of weight and bulk. Thus, the costs of its shipment becomes a recognizable component of their overall cost to the retailer. By meeting the bulk and weight criteria of certain shipping entities, substantial reductions in landed delivered cost savings may be provided for the retailer. Tooling also becomes a cost aspect for sheet metal shelving, the tooling costs required for fabrication of sheet components being somewhat elevated.

Retail merchandising entities also employ portable shelf assemblies configured as vertically stacked sequences of spaced-apart shelves. These smaller racks are positioned in aisleways and the like representing regions of higher customer density. It is desirable that such devices be rigid to withstand contact by customers while remaining sufficiently lightweight so as to be readily positioned from place to place throughout a retail store by employees.

SUMMARY

The present invention is addressed to a rack assembly of relatively low weight, open frame architecture utilizing modular components providing not only a flexibility to accommodate varying display demands, but also enjoying a unique simplicity of assembly. Assembly of the display rack is readily accomplished with minimal instruction, inasmuch as the design of the modules forming the rack structure is, in effect, self prompting to the assembler. No tools are required for assembly and the resulting structure is highly secure and stable. The open frame modules employed with the racks exhibit light weight, but high strength permitting the transportion of unerected display racks to retailing sites using less costly shipping entities. Of particular advantage, the display rack assembly has a pleasing aesthetic appearance, lending to its employment within the ambience of better retailing environments.

Among the modular parts employed with the rack apparatus is an open frame load receiving component formed of vertical loading rods which are coupled with a plurality of regularly spaced, vertically disposed receiving connector assemblies. These load receiving components serve to vertically transmit shelf carried loads substantially in compression to a floor or supporting surface. With this load transferring arrangement, the resilience otherwise exhibited by open frame structuring causes the present structure to assume a vertical, compressive load transfer orientation when otherwise disturbed, for example, by being inadvertently pulled forward, a maneuver tending to tip rigid display structures heretofore used. Assembly is carried out through the utilization of a tab rod based geometry in conjunction with receptor gaps formed by paired connector rods which, in turn, are structured to provide the noted receiving connector assemblies.

The invention also features a lightweight open frame rack assembly having a "tower-like" architecture which enjoys the above-noted ease of assembly and vertical loading rod configuration. The rack readily is positionable by employees at high density customer regions of a retail establishment. In one embodiment, the rack assembly may be combined with floor engaging wheels by which it may be maneuvered in a loaded state. This wheel based movement is made available because of the enhanced rigidity of the structure. The maneuverability of the assembly lends it to a broadened variety of uses beyond retail merchandising. For example, it may be employed to aid secretarial and clerical help in filing within an office environment and may be employed in an industrial environment wherein ready access to various levels of shelving is desirable. Because of its unique modular structuring, the assembly may be employed to provide merchandise display walls and the like.

Another feature of the invention provides an open frame module positionable upon a surface for connection with open frame components to form a vertically upstanding support for items. The module includes a first open frame load receiving component having at least two parallel spaced-apart loading rods of first widthwise cross-sectional dimension, having a lower portion for transferring load to the surface and extending vertically upwardly a select height. The component has a plurality of receiving connector assemblies formed of horizontally disposed, mutually parallel connector rods connected to an outwardly disposed loading rod and extending outwardly therefrom a predetermined distance to define a receptor gap. The connector assemblies are positioned at spaced levels extending upwardly from the vicinity of the lower portion. A second open frame load receiving component is provided having two parallel, spaced-apart loading rods of the first widthwise cross-sectional dimension. The second component has a lower portion for transferring load to the surface and extends vertically upwardly a select height, having a plurality of link assemblies, each link assembly including at least one horizontal end link rod connected to and extending from one of the two loading rods and supporting at least one vertically disposed tab rod of second widthwise cross-sectional dimension less than the first widthwise cross-sectional dimension. The tab rod is slidably insertable within oppositely disposed receptor gaps of another module to a position of substantial parallel adjacency with a loading rod thereof. A U-shaped horizontal cross member is provided having a first side portion connected to the first load receiving component, having a second side portion connected to the second load receiving component and an intermediate portion of predetermined length extending normally from each of the first and second side portions, and defining respective first and second corners therewith. The cross member serves to position the first and second load receiving components in vertical, spaced-apart relationship corresponding with the predetermined length.

Another feature of the invention provides a rack assembly positionable upon a floor for supporting load carrying shelves. The assembly is formed having first and second interconnectable open frame modules. Each of the modules includes a first open frame load receiving component having two parallel, spaced-apart loading rods of first widthwise cross-sectional dimension. The first component further has a lower portion for transferring load to the floor and extends upwardly a select height, having a plurality of receiving connector assemblies formed of horizontally disposed, mutually parallel connector rods connected to an outwardly disposed loading rod, and extending outwardly therefrom a predetermined distance to define a receptor gap. The connector assemblies are positioned at spaced levels extending upwardly from the vicinity of the lower portion. A second open frame load receiving component is provided having two parallel, spaced apart loading rods of the first widthwise cross-sectional dimension and further having a lower portion for transferring load to the floor and extending vertically upwardly a select height. The second load receiving component has a plurality of link assemblies, each link assembly including at least one horizontal end link rod connected to and supported from one of the two loading rods and supporting at least one vertically disposed tab rod of second widthwise cross-sectional dimension less than the first widthwise cross-sectional dimension. A U-shaped horizontal cross member is provided having a first side portion connected to the first load-receiving component, having a second side portion connected to the second load receiving component and having an intermediate portion of predetermined length extending normally from each first and second side portion, and defining respective first and second corners therewith. The cross member serves to position the first and second load receiving components in vertical, spaced-apart relationship corresponding with the predetermined length. The tab rods of the first and second modules are slidably insertable within oppositely disposed receptor gaps of receiving connector assemblies of respective second and first modules to a position of substantial parallel adjacency with an outwardly disposed loading rod to connect the first module with the second module to form a vertically upstanding outer frame surmounting an internal region. At least one shelf is positioned within the internal region which is supported by the outer frame.

Other objects of the invention will, in part, be obvious and will, in part, appear hereinafter. The invention, accordingly, comprises the apparatus and system possessing the construction, combination of elements, and arrangement of parts which are exemplified in the following detailed disclosure.

For a fuller understanding of the nature and objects of the invention, reference should be had to the following detailed description taken in connection with the accompanying drawings.

BRIEF DESCRIPTION OF THE DRAWINGS

FIG. 16 is a perspective view of an open frame module according to the invention;

FIG. 21 is a display inter-connection of modules as illustrated in FIG. 16.

DETAILED DESCRIPTION OF THE INVENTION

Figure 1:
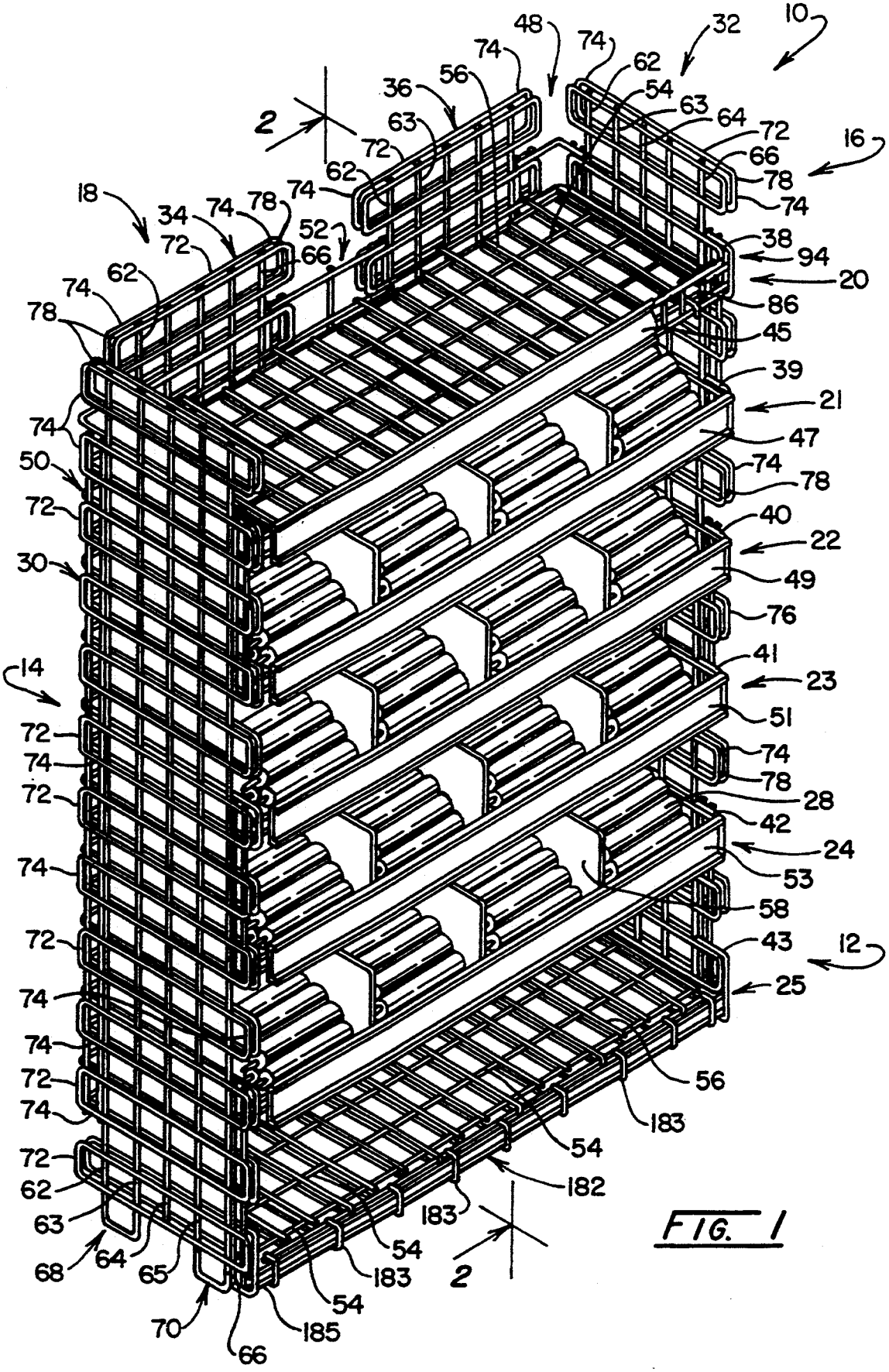
FIG. 1 is a perspective view of a rack assembly according to the invention.

Referring to FIG. 1, a perspective illustration of a rack assembly or display rack according to the invention is represented generally at 10. The assembly 10 is ideally suited for use in a retail sales environment having essentially an all open frame construction which is both light, highly stable, and very easily assembled. In the figure, the assembly 10 is seen to have, in general, a front 12, sides 14 and 16 which are spaced apart a bay width, and a back or back structure 18. This arrangement supports a sequence of shelves 20–25 suitable for carrying a variety of products for display, for example, one such product may be caulking gun inserts as illustrated in the drawing, for example, at 28, supported as a load upon the shelf 24. Typically, the assembly 10 will have a width of 48 inches, a depth of 18 inches, a height of 70 inches, and will be arranged to provide a shelf access vertical gap for shelf-to-shelf spacing of about 12 inches. The assembly 10 is quite modular and may be expanded both laterally and rearwardly employing essentially standardized open frame components or modules.

One of the modular features is observed in the use of a load receiving component. In this regard, load receiving components 30 and 32 are provided which function to provide respective sides 14 and 16. Additionally, load receiving components 34 and 36 are provided which are observed to constitute a portion of the back or back structure 18. These four load receiving components 30–36 carry the loads induced by the products displayed as at 28 to the floor surface upon which the rack or apparatus 10 stands. To provide for this load transfer, the load receiving components are retained in a vertical orientation such that vertically disposed loading rods within them remain substantially in compression, sustaining very little load induced moment. As a consequence, the apparatus 10 may be quite light and suitable for shipment using more efficient shipping entities. Assembly of the four load receiving components 30–36 to form the apparatus 10 is quite simple, being carried out through a tab and slot form of coupling. In this regard, the side position load receiving components 30 and 32 are retained, in part, in their vertical orientation at front 12 by a sequence of horizontal cross members 38–43 seen adjacent respective shelves 20–25. To identify the models or types of goods displayed at the shelves 20–25, elongate face members 46–50 which are structured to carry appropriate signage may be attached to the front portions of the horizontal cross members 38–42. These cross members are insertably connected to the corresponding load receiving components 30 and 32 by inwardly depending end links which are disposed normally to the front portions of the cross members.

In somewhat similar fashion, the opposite or rearwardly disposed vertical sides of the load receiving components 30 and 32 are coupled to the back structure 18 by open frame corner link assemblies represented, respectively, in general at 46 and 48. In this regard, again using a tab and slot form of attachment, the corner link assembly 46 connects one side of load receiving component 30 with a corresponding one side of load receiving component 34 at back structure 18. Similarly, the corner link assembly 48 couples the rearwardly disposed vertical side of load receiving component 32 with one side of load receiving component 36 positioned at the back 18. To unite load receiving components 34 and 36 and thus complete the back structure 18, a connector panel 52 is coupled between these load receiving components utilizing a tab and slot arrangement universal to the assembly 10.

Looking momentarily to the shelves 20–25, it may be observed that they are of an open frame configuration. In particular, looking to top shelf 20 and bottom shelf 25, it may be observed that the shelves are formed of four elongate rods extending along the bay width or widthwise dimension of the apparatus 10, certain of which are shown at 54. These rods are attached, for example, by resistance or spot welding to paired rod beams, certain of which are shown at 56. Certain of these paired rod beams extend to tabs and hooks such that the shelves 20–25 extend and are supported between the horizontal cross members 38–43 and the components 34 and 36 of the back structure 18. It may be observed with the structure of the paired rod beams 56, the uppermost of those beams will be in compression and the lowermost beam in tension under the influence of loads such as those depicted at 28. Note, in particular, that the merchandise displayed by the assembly 10 also may be separated with respect to colors, model numbers, and the like by spacers, certain of which are identified at 58.

Now looking to the identical structuring of the load receiving components, component 30 is revealed in FIG. 1 as having a plurality of parallel, spaced apart, vertical loading rods 62–66. These rods have a predetermined widthwise cross sectional dimension. In this regard, the rods may be of rectangular or circular cross section, that cross section preferably being circular. In a preferred arrangement, the rods will have a cross sectional diameter of about $\frac{1}{4}$ inch. Of these rods, rear outermost rods 62 and next adjacent rod 63 are formed in looped fashion at 68 to provide a horizontal foot which functions as a load transfer portion partially transferring the shelf based loads to a floor surface upon which the assembly 10 is positioned. Similarly, loading rods 65 and 66 terminate in a load transfer lower portion present as a loop or foot 70.

Retaining the loading rods 62–66 in proper transversely spaced orientations to assure verticality in the completed apparatus 10, are a plurality of horizontally disposed mutually parallel connector rods. These connector rods are paired, regularly vertically spaced mutually parallel and preferably formed as parallelogramic loops, certain of which are identified at 72. These parallelogramic loops extend outwardly and oppositely from the outermost loading rods as at 62 and 66 and form receiving connector assemblies, certain of which are represented at 74 and 76. Particularly looking to the uppermost ones of the receiving connector assemblies 74 in FIG. 1, it may be observed that the paired connector rods, being spaced apart by the widthwise cross sectional dimension of loading rods 62 and 66, function to form or define a receptor gap, certain of which are shown at 78. Preferably, the connector rods 72 mutually converge at the receiving connector assemblies 74 to provide a gripping engagement with the tab forming components that are insert therein. The extent of these gaps 78 also is controlled by the parameters selected in the course of resistance welding the connector rods to the loading rods. This is controlled, for example, by regulating the amount of current, the length of welding, and pressure. In a preferred arrangement, for a loading rod cross sectional diameter of ¼ inch, the cross sectional diameter of the connector rod 72 is selected as about 3/16th of an inch.

Figure 2:
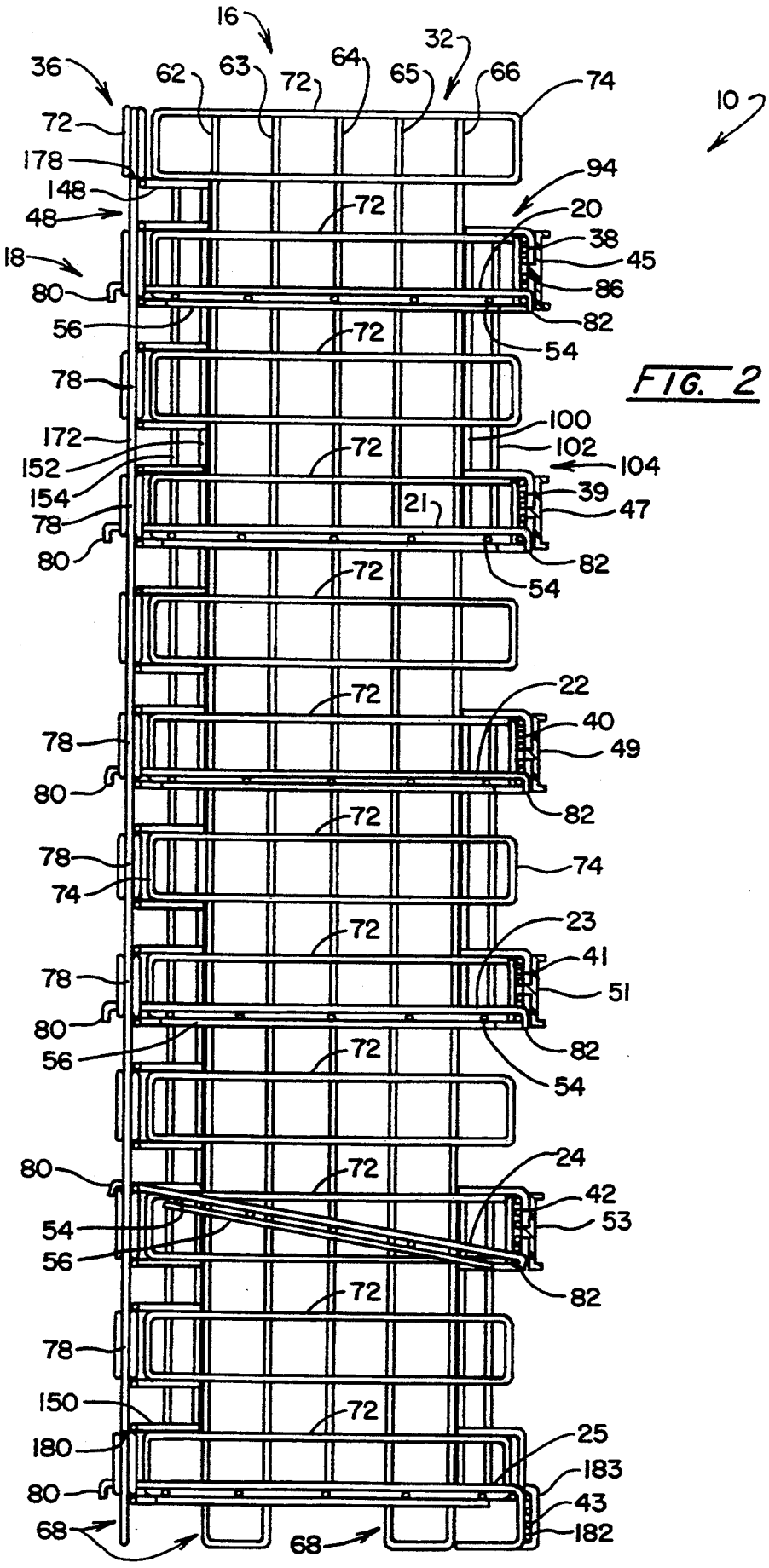
FIG. 2 is a side view of the rack assembly of FIG. 1 taken through the plane 2—2 thereof.

Referring to FIG. 2, a plan or side view of a load receiving component, in particular, that shown in FIG. 1 at 32 and side 12, is revealed in conjunction with an edge view of the load receiving component 36 and portions of the interconnecting connector panel 52 and corner link assembly 48.

FIG. 2 also reveals a side view of the shelves 20–25. In this regard, the view identifies the technique of their mounting within the assembly 10. For example, about every third of the paired rod beams 56 of the shelves extend to form rearwardly disposed, hook shaped connectors 80 which, for shelves at 20–23 as are mounted horizontally, appear to protrude somewhat from the back structure 18. These same paired rod beams 56 having the connectors 80 also are formed to provide downwardly depending tabs 82 which connect at two transverse rods of the horizontal cross members 38–43. It may be observed that with the extended hook-like connectors 80, the shelves, for example that at 24, may be tilted upwardly at the rear to provide a feed forward slope for rolling or sliding products to make customer access easier.

Figure 3:
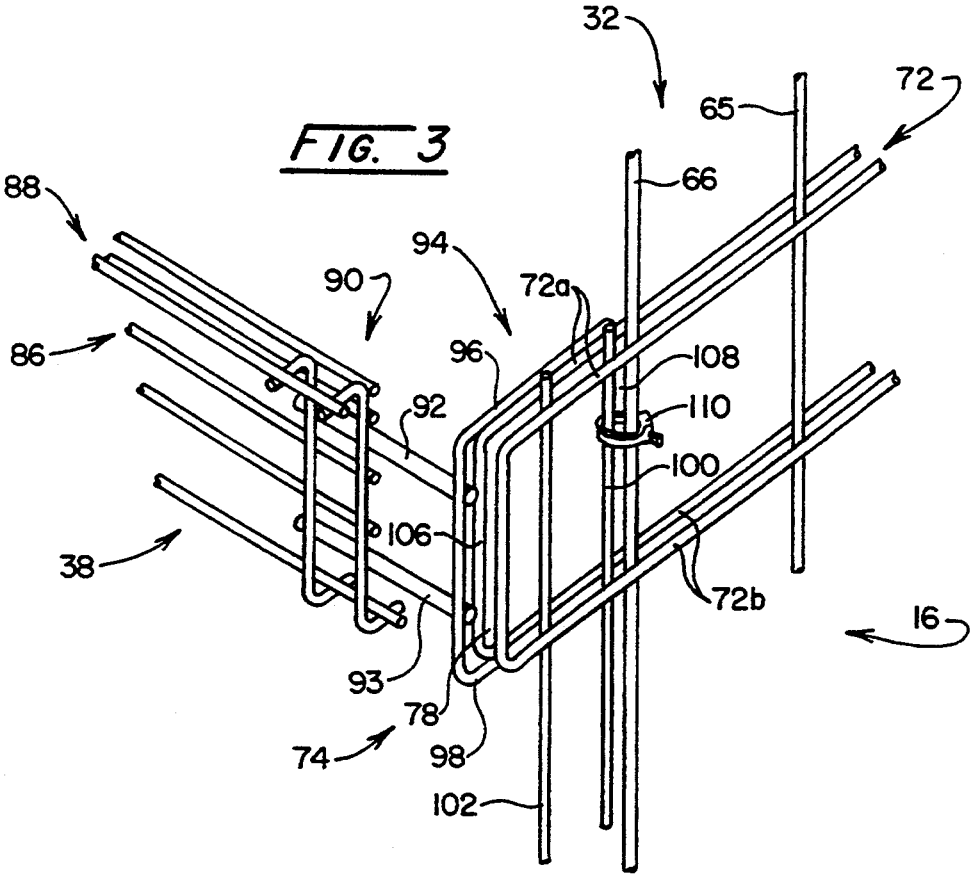
FIG. 3 is a partial perspective view of one side of a cross member and load receiving component interconnection employed with the assembly of FIG. 1.

Looking with particularity to the structuring of the horizontal cross members 38–43, reference additionally is made to FIG. 3 where the cross member 38 is revealed in enhanced perspective detail at one end thereof. The member 38, as it extends across the bay width of the front 12 of apparatus 10 is formed of a horizontal and parallel series of six vertically spaced and parallel front rods represented generally at 86. Of these six front rods, one closely adjacent pair as seen at 88 serve to receive the front connectors 82 of the shelves as described in connection with FIG. 2. The six front rods are interconnected by a front connector 90 which is fashioned of two parallel S-shaped rods. All of these components as at 86 and 90 of the horizontal cross member 38 are formed, for example, of 3/16th diameter steel wire, permitting them to be of minimum weight but of fully sufficient strength. Affixed to and extending outwardly from the connector pair 90 are two horizontally disposed alignment bars 92 and 93. Bars 92 and 93 are seen to be of larger cross sectional dimension, for example ¼th inch diameter. Bars 92 and 93 serve to terminate the widthwise or bay length extent of the horizontal cross members 38 whereupon the component 38 transitions normally to its front portion to form an end link represented generally at 94. End link 94 is formed as a U-shaped component with two, parallel horizontal end link rods 96 and 98. End link rods 96 and 98 are spaced apart vertically a tab height and serve to support the vertical tab rod arrangement seen formed of tab rods 100 and 102. Looking momentarily to FIG. 2, it may be observed that these tab rods 100 and 102 extend downwardly and are part of the corresponding and identical end link 104 of horizontal cross member 39. The length of these rods 100 and 102 is such that the components 38 and 39 are spaced apart by three levels of receiving connector assemblies.

Figure 4:
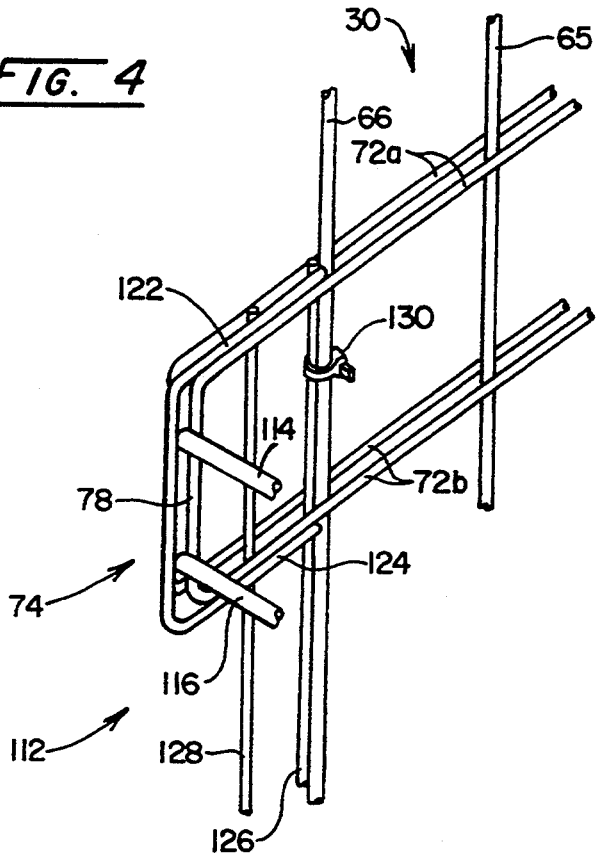
FIG. 4 is a partial perspective view of the opposite side of the connector assembly shown in FIG. 3.

Returning to FIG. 3, the connector rod assemblage 72 is seen to be formed as a parallelogramic loop having paired parallel top loop components 72*a* and paired parallel bottom loop or rod components 72*b*. These components function to develop the earlier-noted receptor gap 78. In assembly, the tab rods 100 and 102 are slidably inserted within and retained by this gap 78. In this regard, the extent of the gap 78 is determined by the connection between paired connector rods 72*a* with loading rod 66 and the connection between paired connector rods 72*b* with that outwardly disposed loading rod 66. Where the rods are resistance welded, the extent of the gap 78 can be adjusted as part of that welding procedure. Additionally, the ends of the receiving connector assembly 74 thus formed may converge to provide an enhanced press fit against the tab rods 100 and 102. In a preferred arrangement, the connector rods 72*a* and 72*b* as well as the tab rods 100 and 102 are provided having a diameter of 3/16th inch. Correspondingly, the diameter of the loading rod 66 is ¼th inch. By controlling the noted resistance welding, the gap 78 will be about 3/16th inch in extent. Generally, it is preferred that the gap 78 fall within a range of 3/16th inch to ¼th inch in extent. In the course of assembly, as the tab rods 100 and 102 of the end link 94 are inserted within the gap 78, the horizontally disposed alignment bars 92 and 94 will move into contact with the vertical component 106 of the receiving connector assembly 74. For this side 16 of the assembly 10, outwardly disposed tab rod 100 will be spaced from loading rod 66 an amount equivalent to the widthwise cross sectional dimension of rod 100. Thus, a gap 108 is developed between tab rod 100 and loading rod 66. Additionally, the horizontal top end link rod 96 will be positioned over and in parallel abutment with one top connector rod 72*a*, while the oppositely disposed horizontal bottom end link rod 98 will move into abutment with an oppositely disposed connector rod at 72*b*. With the arrangement, vertical loading is thus transferred to the load receiving component 32 as may have been present at this considered side of the horizontal cross member 38. In practice, it has been found that the tab and slot connection thus provided is fully sufficient, without more, to retain the horizontal cross member 38 in connection with load receiving component 32. However, as a safety feature, a polymeric tie as represented at 110 may be connected around the vertical, parallel, and adjacent tab rod 100 and loading rod 66 to assure their continued verticality. It is this vertical transfer of load to the loading rods which enhances the stability of the rack apparatus. Cross member 38 extends the bay width of apparatus 10 to another end link assembly for connection with an appropriate receiving connector assembly 72 at the same level and within load receiving component 30 as illustrated in FIG. 1. Referring to FIG. 4, this oppositely disposed end link of the cross member 38 is represented generally at 112 and shown in united slot and tab connection with load receiving member 30. End link assembly 112 is coupled, as in the case of end link assembly 94, with two horizontally disposed alignment bars 114 and 116 which are attached to a connector as described in connection with FIG. 3 at 90 but now shown in FIG. 4. Link 112, as before, includes a D-shaped assemblage of end link rods 122 and 124 arranged normally to the front portion of the cross member 38. These end link rods 122 and 124 support a tab rod assembly including tab rods 126 and 128. Rods 126 and 128, for example, are resistance welded to the link rods 122 and 124. The end link 112, as before, is slidably retained with the receptor slot 78 formed by the paired connector rod components 72*a* and 72*b* of a receiving connector assembly 74 coupled, inter alia, to loading rods 65 and 66 of the load receiving component 30. Note, however, in comparison with the end link 94 that the tab rod 126 of end link 112 nests in abutting parallel adjacency against outwardly disposed loading rod 66. This slight alteration in the positioning of tab rod 100 in the case of end link 94 and tab rod 126 in the case of end link 112 will be seen to permit the convenient expansion of the bay width of a given assembly 10. As before, a polymeric tie as at 130 may be employed to assure the abutting adjacency and verticality between rods 126 and 66. It further may be noted that the rods 126 and 128 extend to and form the tab rods of the next lower adjacent cross member 39 as is the case for tab rods 100 and 102 as described in FIG. 3. As before, rod interconnections preferably are made by resistance welding.

Figure 5:
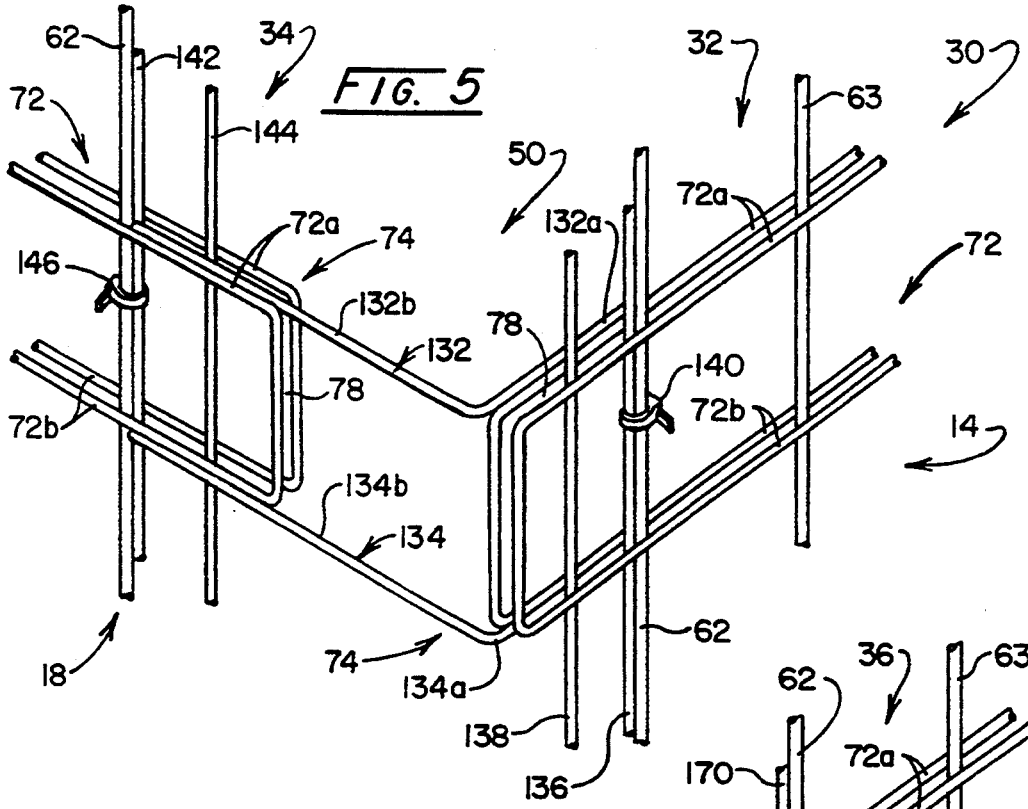
FIG. 5 is a partial perspective view of a corner link assembly employed with the apparatus of FIG. 1.

Now considering the corner link assemblies 48 and 50 as discussed in general in connection with FIG. 1, reference is made to FIG. 5 where a partial perspective illustration of corner link assembly 50 is shown in conjunction with adjacent load receiving component 30 at side 14 of the apparatus 10 and load receiving component 34 at the back structure 18 thereof. Corner link assemblies 48 and 50 are structured identically for the preferred embodiment. However, when so structured, one is inverted vertically with respect to the other. FIG. 5 reveals that a corner link assembly is formed of a plurality of parallel and horizontally disposed corner link rods, two adjacent ones of which are shown at 132 and 134. Each of the corner link rods 132 and 134 have a first portion respectively at 132*a* and 134*a* which extends to a vertical corner tab rod assembly including vertical tab rods 136 and 138. As before, these rods 136 and 138 may be attached to the rod portions 132*a* and 134*a* by resistance welding or the like. The tab rods 138 and 136 are seen slidably inserted within the receptor gap 78 of the receiving connector assemblies 74 of the load receiving component 30. Note that vertical tab rod 136 is positioned in parallel abutting adjacency with vertical loading rod 62 of the load receiving component 30. To provide a modicum of safety, as before, a polymeric tie such as at 140 may be utilized to assure the securement and retention within receptor gap 78. One or two ties may be employed in vertically spaced relationship for the corner link assembly application.

The second portions of corner link rods 132 and 134 respectively as at 132*b* and 134*b* are formed normally to the first portions at 132*a* and 134*a*, and extend to a vertical tab rod assembly including vertical corner tab rods 142 and 144. Connection to respective corner link rod portions 132*b* and 134*b* may, as before, be provided by resistance welding. Utilizing the uniform tab and slot assembly approach, vertical corner tab rods 142 and 144 are inserted within the receptor slot 78 of the receiving connector assembly 72 of load receiving component 34 at the back structure 18. Note, as before, that the vertical corner tab rod 142 is in parallel abutting adjacency with vertical loading rod 62 of the component 34. To assure the maintenance of this connecting association, two or more polymeric ties, one of which is shown at 146, may be utilized to tie them together. As before, such small and light tying components may be utilized inasmuch as load imposed forces are vertical and very little lateral moment induced or transverse forces are encountered within the apparatus 10.

The height of the corner link assemblies 48 and 50 is selected such that, for example, they do not touch the floor surface. This height aspect with respect to corner link assembly 48 is seen in FIG. 2. Where that corner link assembly extends upwardly to a corner link rod 148 and downwardly to a corner link rod 150. Note in the figure the associated vertical corner tab rods 152 and 154. All rods making up the corner link assembly 50 are of the lesser cross-sectional dimension, for example, 3/16 inch.

Figure 6:
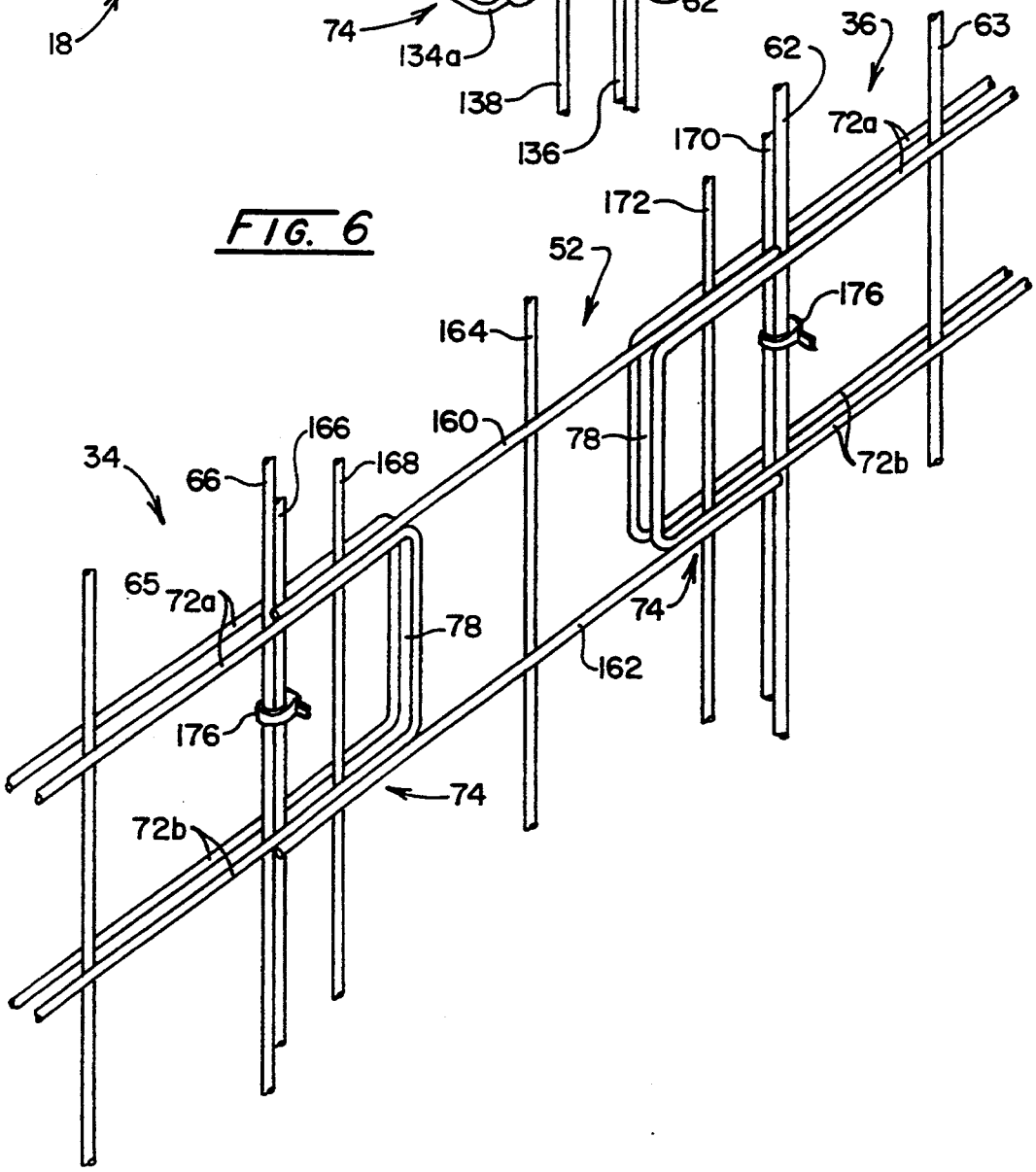
FIG. 6 is a partial perspective view showing a connector panel and interconnected load receiving components employed with the appartus of FIG. 1.

As described in connection with FIG. 1, the back structure 18 is formed of two load receiving components 34 and 36 which are interconnected at the center of the assembly 10 by a connector panel 52. Referring to FIG. 6, the structuring of this open frame connector panel 52 is represented in partial perspective view in conjunction with portions of the associated load receiving components 34 and 36. Connector panel 52 is seen to be formed of a plurality of regularly spaced horizontally disposed panel link rods, two of which are revealed at 160 and 162. The vertical spacing between rods 160 and 162 is the same as the earlier-noted tab height described in connection with end links 94 and 96 illustrated in FIG. 3. The plurality of rods as at 160 and 162 are supported in their horizontal orientations by a vertical rod 164 as well as the outwardly disposed vertical panel tab rod assembly including panel tab rods 166 and 168, and panel tab rods 170 and 172. Similar to the earlier tab and receptor gap assembly, the panel tab rods 166 and 168 are inserted within the receptor gap 78 of the receiving connector assemblies 74 of receiving component 34. Note that vertical panel tab rod 166 is in parallel abutting adjacency with outwardly disposed loading rod 66 of load receiving component 34. In similar fashion, vertical panel tab rods 170 and 172 are slidably inserted and retained within the receptor gap 78 of the receiving connector assemblies 74 of load receiving component 36. Note in this regard that the vertical panel tab rod 170 is in parallel abutting adjacency with vertical loading rod 62. To assure the integrity of the connection of connector panel 52 with the associated load receiving components 34 and 36, small polymeric ties, two of which are shown at 174 and 176 may be employed. As before, because of the relatively light transverse loadings involved, these small and light ties are fully adequate to assure the adjacency of rod 166 with rod 66 and the adjacency of rod 170 with rod 62. Connection of all rod components of panel 52 preferably is by resistance welding.

Connector panel 52 also is of restricted length. As seen in FIG. 2, panel tab rod 172 terminates upwardly at 178 and at level 180 at the bottom of the assembly 10. Thus, all load weight essentially is received by the vertical loading rods of the load receiving components. As before, the widthwise cross sectional dimension for all of the rod components of connecting panel 52 are of lesser extent than the corresponding dimensions for the loading rods as at 62–66. In this regard, in a preferred embodiment, the rod components of panel 52 are, for example, 3/16th of an inch in diameter.

Figure 7:
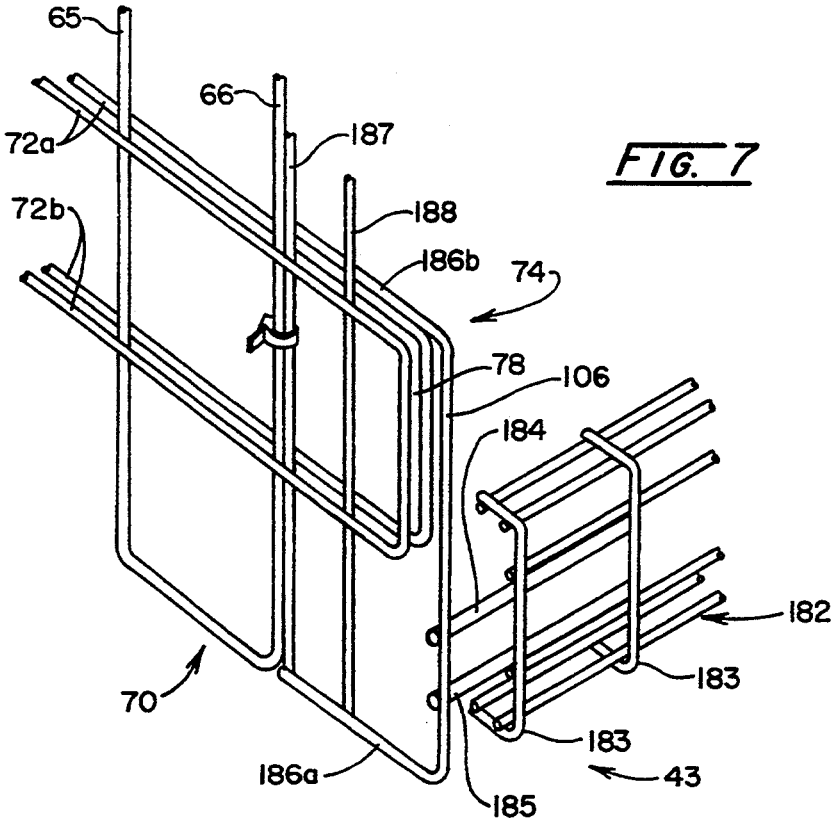
FIG. 7 is a partial perspective view of one side of a lowermost cross member and load receiving component interconnection employed with the assembly of FIG. 1.

Looking to the very bottom cross member as identified at 43 in FIGS. 1 and 2, a minor structural variation may be observed, inasmuch as this lowest cross member serves the additional purpose of providing a kick panel. However, its employment with the receiving connector assembly 74, gaps 78, and loading rods remains essentially the same as the cross members described above. Looking to FIG. 7, the cross member 43 is seen to be comprised of six horizontally disposed front rods represented in general at 182. FIG. 1 reveals that these front rods are held in their horizontal orientations by a plurality of U-shaped connectors, certain of which are shown at 183. Two front rods within the grouping 182 also support two parallel vertically spaced apart horizontally disposed alignment bars 184 and 185 which are connected to a vertically extended end link 186. The bottom end link rod **186*a* is seen to extend essentially to ground level in parallel with the foot 70 formed of end link rods 65 and 66. The end link 186 then extends upwardly to top end link rod 186*b* and these end link rods extend to connection with a tab rod assembly which extends upwardly to form the tab rods in common with cross member 42 and as are shown at 187 and 188. End rods 187 and 188, as before, are insertable within and retained by the receptor gap 78 of the lowermost position receiving connector assembly 74. The positioning of the tab rods 187 and 188 is varied between the two sides of the cross-member 143 in the same manner as the upwardly disposed cross members 38–42. Note that the outermost tab rod 187 is seen to be in parallel abutting adjacency with outermost disposed loading rod 66. As before, the connection of those components forming the assembly 43 is by resistance welding. Small polymeric ties (not shown) as described above may be employed as a safety precaution retaining the innermost tab rods with the outwardly disposed loading rods as at 66 for all of the tab and slot connections at the front of the assembly 10**.

Figure 8:
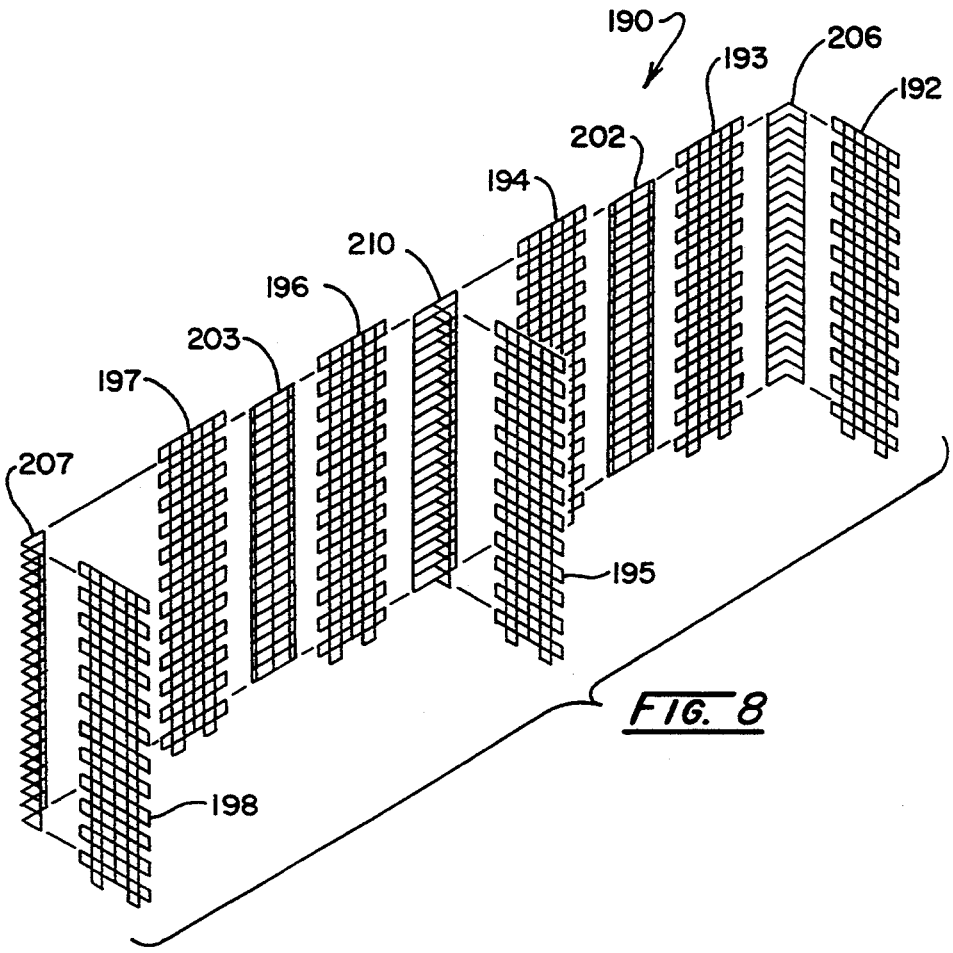
FIG. 8 is a schematic, exploded representation of the display apparatus according to the invention and showing expansion of the display apparatus of FIG. 1.

Because of the utilization of load receiving components employing regularly dimensioned and spaced receiving connector assemblies which perform with tab rod based systems, a desirable architectural flexibility or modularity is achieved. FIG. 8 illustrates one aspect of that flexibility where the basic components are conjoined to evoke a doubling of the available bay widthwise dimension of a rack assembly. In FIG. 8, in exploded and simplified form, the back and side components for such an expanded architecture are revealed generally at 190. In this regard, it may be observed that seven load receiving components 192–198 are employed, the two side load receiving components being those identified at 192 and 198. A centrally disposed component 195 is seen to be parallel with those two side defining elements. At the back structure load retaining components 193, 194, and 196, 197, are combined with respective connector panels 202 and 203. Corner link assemblies 206 and 207 respectively couple load receiving components 192 and 193, and 197 and 198. To unite all of the back structure elements, a "T-shaped" extender link assembly 210 is provided interconnecting load receiving components 194–196. The extender link assembly function 210 can be implemented in two ways. Preferably, the extender link 210 is utilized, however, two corner links may be employed with an alignment generating alteration of the corner tab rod positioning.

Figure 9:
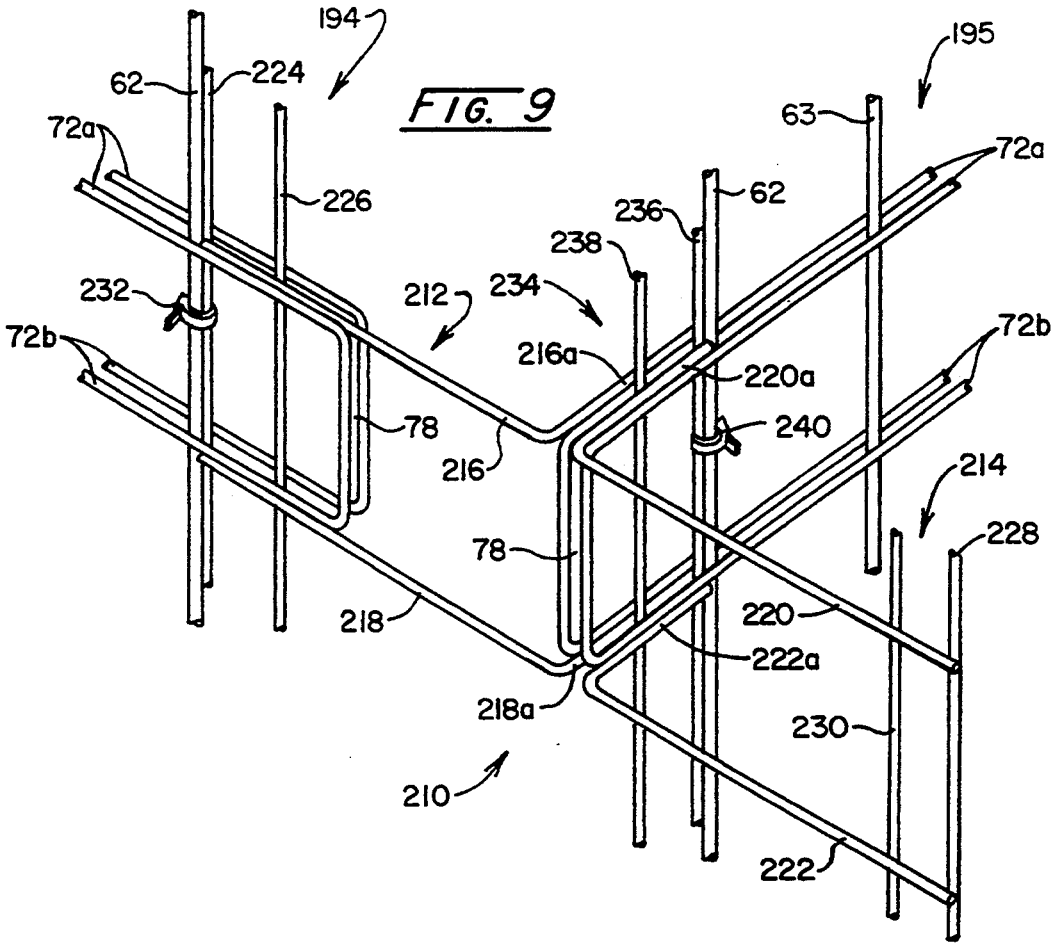
FIG. 9 is a partial perspective view showing an extender link assembly employed with the assemblage of FIG. 8.

Referring to FIG. 9, the singular T-shaped extender link assembly 210 is revealed in partial perspective as it is positioned in conjunction with load receiving components such as those described at 194–196 in FIG. 8. In the figure, the assembly 210 is seen to be comprised of two co-planar portions 212 and 214 which are formed of a plurality of horizontally disposed extender link rods. In this regard, extender link rods 216 and 218 are seen within portion 212, while extender link rods 220 and 222 are illustrated at coplanar portion 214. Extender link rods 216 and 218 extend to and are connected to an extender tab assembly including extender tab rods 224 and 226. Similarly, extender link rods 220 and 222 of portion 214 extend to extender tab rods 228 and 230. Extender tab rods 224 and 226 are seen to have been received within the receptor gap 78 of a receiving connector assembly of load receiving component 194. In this regard, the outermost extender tab rod 224 is seen to be positioned in parallel abutting adjacency with outwardly disposed loading rod 62 and the extender link rods 216 and 218 are seen to be positioned, respectively, above and below the connector rods **72*a* and 72*b* of the receiving connector assembly illustrated. A small polymeric tie 232 assures the retention of the abutting association of rods 224 and 62**.

The extender link assembly 210 further is structured having a third portion 234 disposed normally to the coplanar portions 212 and 214. In this regard, extender link rods 216 and 218 are seen to be bent to the orientation shown, respectively at **216*a* and 218*a*, while the corresponding extender link rods 220 and 222 are shown bent at the third portion 234 as respectively shown at 220*a* and 222*a*. This combination of extender tab rods at the third portion 234 extend to and are fastened by resistance welding or the like to vertically oriented extender tab rods 236 and 238. Rods 236 and 238 are seen to be slidably retained within receptor gap 78 of the receiving connector assembly formed by connector rods 72*a* and 72*b* at load receiving component 195. Note that extender tab rod 236 is located in parallel abutting adjacency with outwardly disposed loading rod 62 of the component 195 and this orientation is assured through the utilization of a small polymeric tie 240. All of the components of assembly 210** may be formed of rods of lesser cross sectional dimension, for example, 3/16 inch, by resistance welding.

Figure 10:
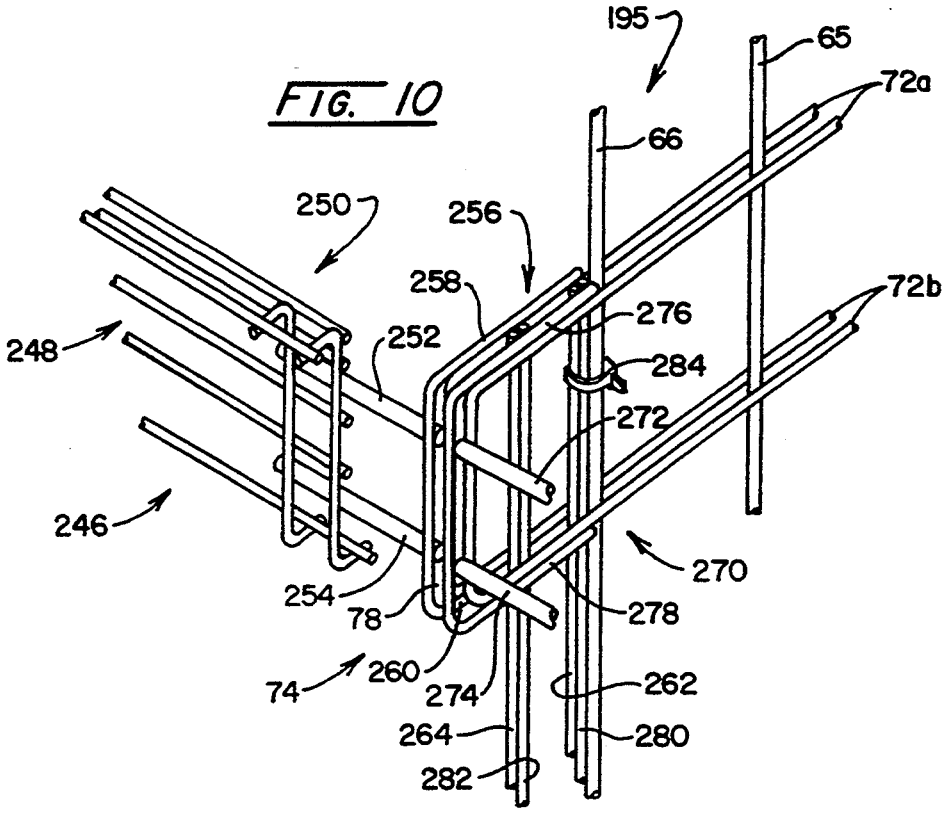
FIG. 10 is a partial perspective view showing a common cross member connecting structure employed with the assemblage of FIG. 8.

Now considering the positioning of cross members within expanded architectures such as at 190 as seen in FIG. 8, it may be recalled from the discussions in connection with FIGS. 3 and 4 that a slight variation occurs in the positioning of the tab rod assemblies within opposite sides of a given such cross member. In this regard, FIG. 3 shows that tab rod 100 is spaced from loading rod 66 by a gap identified at 108 corresponding with the cross sectional widthwise extent of the rod 100. Correspondingly, as demonstrated in connection with FIG. 4, the opposite end link of that same cross member positioned the outwardly disposed tab rod in abutting adjacency with a corresponding outwardly disposed loading rod of the opposite load receiving component. This arrangement permits the common insertion of two end links within the same receptor gap of a receiving connector assembly without disrupting the linear alignment of adjacent cross members at the same shelf level. This desirable attribute is illustrated in connection with FIG. 10. Referring to FIG. 10, the centrally disposed load receiving component 195 of the expanded arrangement of FIG. 8 is revealed to the extent of an outwardly disposed loading rod 66 as associated with a receiving connector assembly 74 with paired top connector rods **72*a* and paired bottom connector rods 72*b* providing a receptor gap 78. Connected to the receiving connector assembly 74 is one side of a cross member represented generally at 246. Cross member 246 includes six horizontally disposed parallel front rods represented generally at 248 which are joined at one side of the cross member 246 by a front connection assembly 250. As before, joining is, for example, by resistance welding. Coupled additionally to the front connector 250 are two spaced parallel alignment bars 252 and 254 which extend outwardly horizontally to an end link represented generally at 256. End link 256 is formed two spaced, parallel end link rods 258 and 260 which are seen to extend to a tab rod assembly including vertical tab rods 262 and 264. Rod 262 is seen to be positioned in parallel spaced adjacency with respect to vertical loading rod 66. Additionally, the inwardly facing outer surfaces of the alignment bars 252 and 254 will have touched the vertical outer loop component of the receiving connector assembly 74 to so position the tab rods 262 and 264**.

FIG. 9 also reveals the end link represented generally at 270 of a next adjacent cross member. This end link is structured in the manner described in connection with FIG. 4. Note, in this regard, that two spaced and parallel horizontal alignment bars 272 and 274 extend to and are connected, for example, by resistance welding to the end link 270 which, in turn, is formed of horizontal end link rods 276 and 278. These end link rods 276 and 278 extend to a tab rod assembly including vertical tab rod 280 and 282. Note that tab rod 280 is in parallel abutting adjacency with loading rod 66. It also is inboard with respect to that rod of vertical tab rod 262 of end link 256. As before, a small polymeric tie 284 provides a safety feature maintaining the verticality and parallel adjacency of the tab rod assembly with outwardly disposed loading rod 66. Thus, a lengthwise alignment of the front portions of two adjacent cross members is effected when the tab rod of one connector assembly and the oppositely oriented tab rod of the other are commonly retained within a receiving connector assembly 74 which includes the receptor gap 78.

Figure 11:
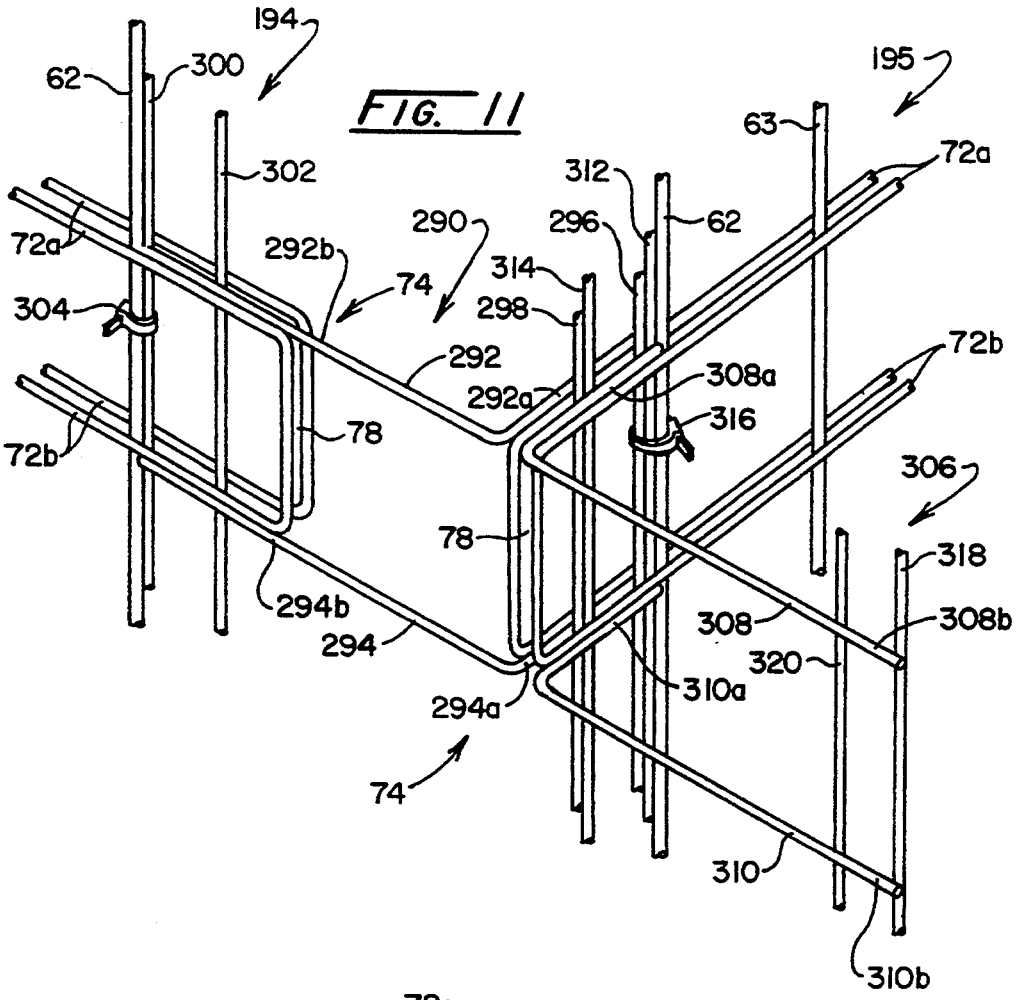
FIG. 11 is a partial perspective view showing a modification of corner link assemblies for use with expanded versions of the rack assembly as represented in FIG. 8.

This same relative tab rod spacing procedure can be employed with corner link assemblies as an alternative to the extender link assembly 210 discussed above in connection with FIG. 9. Referring to FIG. 11, the centrally disposed load receiving component 195 as discussed in connection with FIG. 8 is partially revealed in perspective fashion in connection with a singular receiving connector assembly 74 incorporating gap 78 formed in conjunction with parallel spaced and paired top connector **72*a* and bottom connector rod 72*b*. Similarly, the load receiving component 94 within the back structure of the assemblage of FIG. 8 is partially revealed as including outwardly disposed loading rods 72 and associated receiving connector assembly 74 with receptor gap 78, top connector paired horizontal connector rods 72*a* and bottom paired parallel connector rods 72*b*. One corner link assembly 290 is seen interconnecting load receiving components 194 and 195. The corner link assemblage as before is formed of a plurality of horizontally disposed corner link rods 292 and 294. A first portion of these corner link rods as at 292*a* and 294*a* extend to and are connected with corner tab rods 296 and 298. These corner tab rods 296 and 298 are seen inserted within the receptor gap 78 of the receiving connector assembly 74 of load receiving member 195. Note, however, that corner tab rod 296 is in spaced parallel adjacency with outwardly disposed loading rod 62 of the load receiving component 195. The corner link rods 292 and 294 then extend normally with a second portion 292*b* and 294*b* to the support of corner tab rods 300 and 302. Note that in consistent fashion, the corner tab rod 300 is positioned in abutting adjacency with outwardly disposed loading rod 62. Additionally, a small polymeric tie 304** assures the maintenance of that abutting adjacency.

A second corner link assembly is shown in general at 306. Assembly 306, as before, is comprised of a plurality of horizontal and parallel corner link rods, two of which are revealed at 308 and 310. A first portion of these corner link rods as at **308*a* and 310*a* extend to a corner tab rod assembly including corner tab rods 312 and 314. Note that rod 312 is in parallel abutting adjacency with corner tab rod 296 of corner link assembly 290. That grouping of abutting rods 62, 312, and 296 is further secured by a small polymeric tie 316**.

Rods 308 and 310 also extend as a second portion **308*b* and 310*b* normal to the first portion to a corner tab rod assembly including vertically disposed corner tab rods 318 and 320. These corner tab rods are slidably received within a next adjacent load receiving component such as that at 196 as described in conjunction with FIG. 8. Preferably, all components of the assemblies 290 and 306** are of lesser cross sectional dimension, for example, 3/16 inch diameter. All connections forming them preferably are made by resistance welding.

Figure 12:
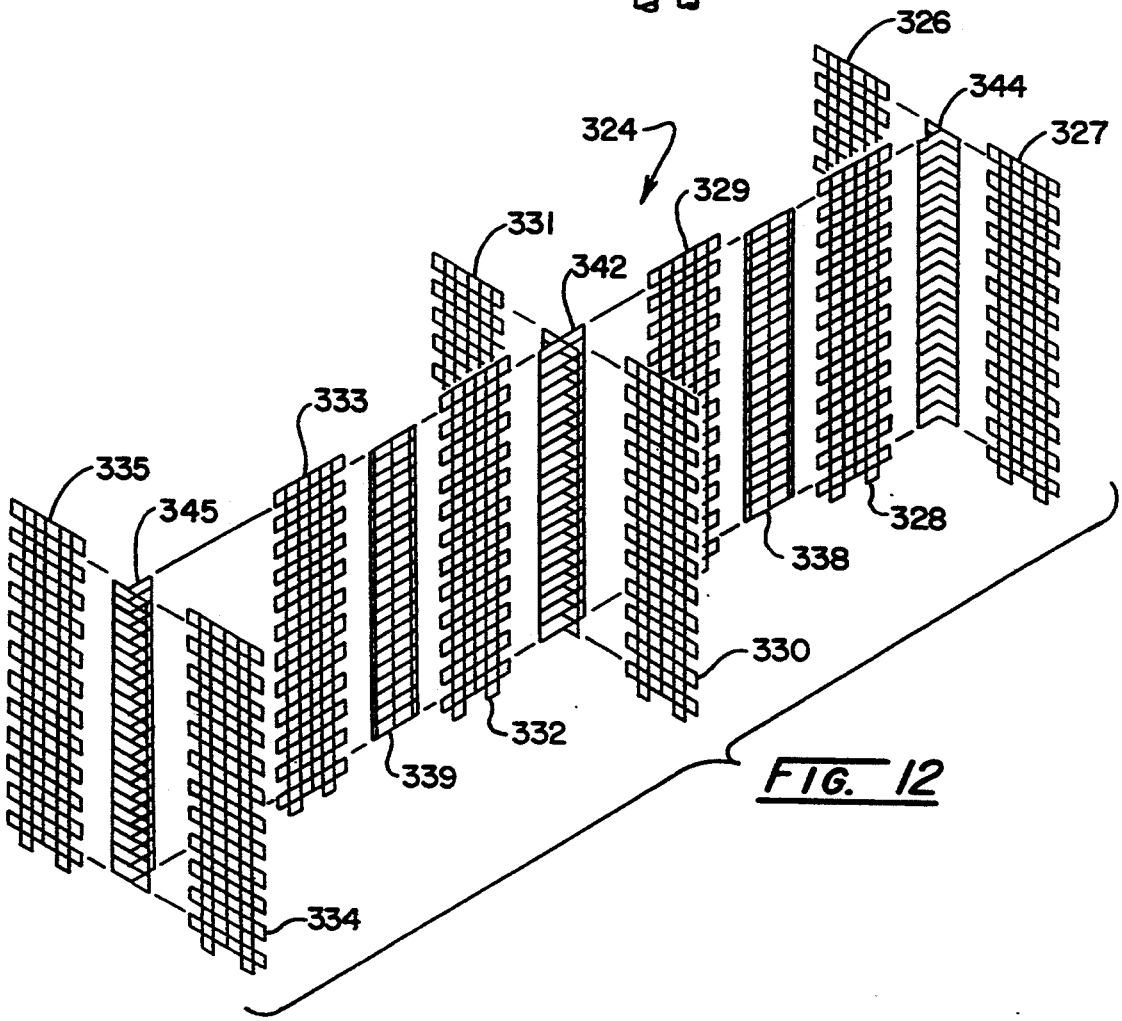
FIG. 12 is an exploded schematic view showing another expanded version of the rack assembly of FIG. 1.

As a further demonstration of the modularity or flexibility of the display apparatus of the invention, reference is made to FIG. 12 where the somewhat standardized components again are employed to form a display rack structure of four bays arranged in back-to-back fashion as represented generally at 324. Rack assembly 324 utilizes ten load receiving components 326–335 in conjunction with two open frame connector panels 338 and 339. The above standardized components are combined with a modified extender link 342 which has a "cross" shape and two modified corner links 344 and 345 which have structures quite similar to the extender link assembly 212 described in connection with FIG. 9. Modified extender link assembly 344 is, in effect, two of the assemblies 210 which are interconnected at their tab rods as described in conjunction with FIG. 9.

Figure 13:
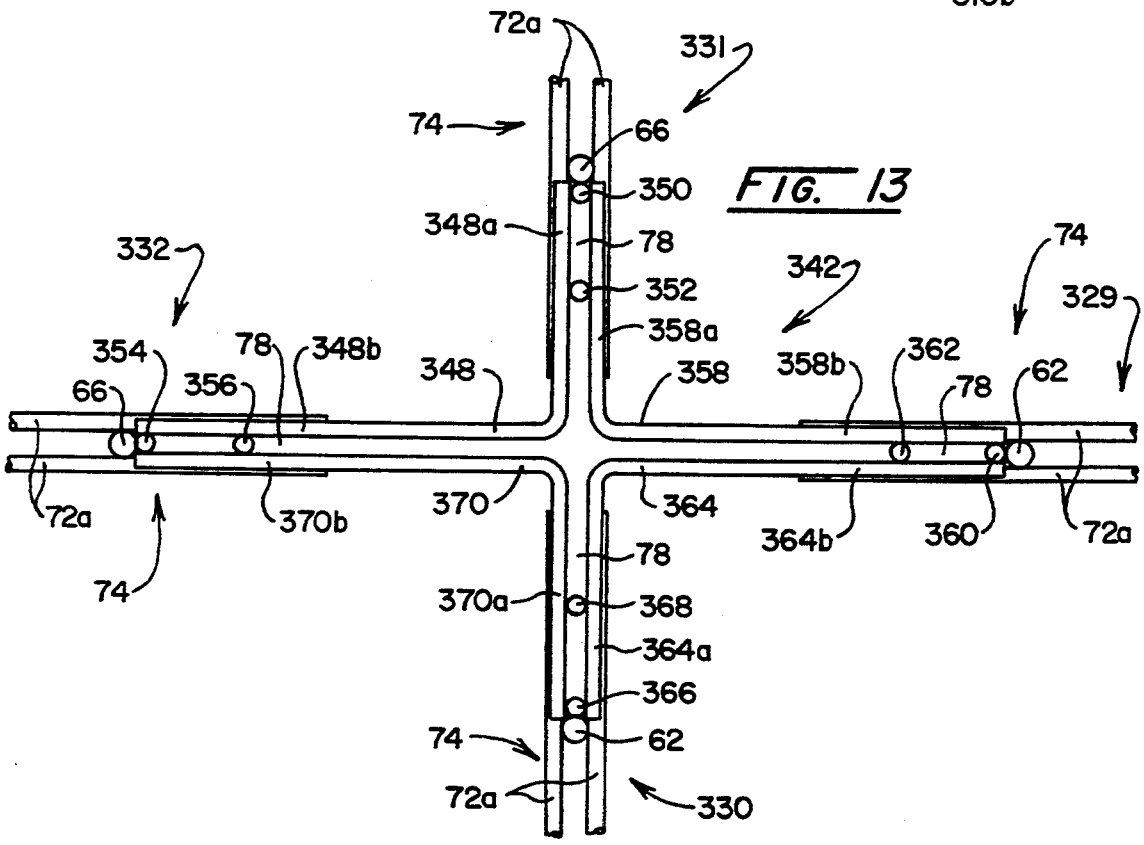
FIG. 13 is a top view of a modified extender link assembly employed with the rack assembly of FIG. 12.

Referring to FIG. 13, the modified extender 342 is revealed as a partial top view in conjunction with the receiving connector assembly 74 of the adjacently coupled load receiving component 329–332. As before, the assembly 342 is formed of a plurality of horizontally disposed extender link rods bent to extend into normally disposed planar configurations. In this regard, note that the extender link rods 348 have one portion at **348*a* extending and affixed to a vertical extender tab rod assembly including extender tab rods 350 and 352. These rods 350 and 352 are within the receptor gap 78 of a receiving connector assembly 74 of loading component 331. Note that extender tab rod 350 is in abutting parallel adjacency with load rod 66 of the component 331**.

The second portion of the extender link rods 348 as at **348*b* extend normally to the first portion to an extender tab rod assembly including extender tab rods 354 and 356. These extender tab rods 354 and 356 are engaged within the receptor gap 78 of the receiving connector assemblies 74 of load receiving component 332. Note in this regard that extender tab rod 354 is in parallel abutting adjacency with vertical loading rod 66. In similar fashion, a plurality of regularly spaced horizontal extender rods 358 are revealed having first portions 358*a* extending and fixed to vertical extender tab rods 350 and 352. Correspondingly, the normally disposed portions of these connector rods extend as at 358b to resistance welded attachment with vertical extender tab rods 360 and 362. These tab rods 360 and 362 are inserted within the receptor gaps 78 of receiving connector assembly 74 of load receiving component 329. Note in this regard that vertical extender tab rod 360 is in parallel abutting adjacency with outwardly disposed vertical loading rod 62 of the component 329**.

Assembly 342 additionally includes a plurality of regularly spaced horiziontally disposed extender link rods 364 having one portion identified at 364a extending to a vertical extender tab rod assembly including extender tab rods 366 and 368. Tab rods 366 and 368 extend within the receptor gaps 78 of receiving connector assembly 74 formed within load receiving component 330. Note in this regard that extender tab rod 366 is in parallel abutting adjacency with corresponding outwardly disposed vertical loading rod 62 of the component 330. The second portion of horizontal extender link rods 364 at 364b extends to and is connected with extender tab rods 360 and 362. Finally, a plurality of horizontally disposed extender link rods 370 are provided having an initial portion 370a extending to and connected with vertical extender tab rods 366 and 368. The second normally disposed portion of the extender link rods 370 at 370b extend to and are connected with vertical extender tab rods 354 and 356. All of the connections for the assemblage 342 are preferably provided by resistance welding and the dimensions of the rod components fall within the criteria, for example, of the expander described in connection with FIG. 11 and the corner components as described in connection with FIG. 5.

Figure 14:
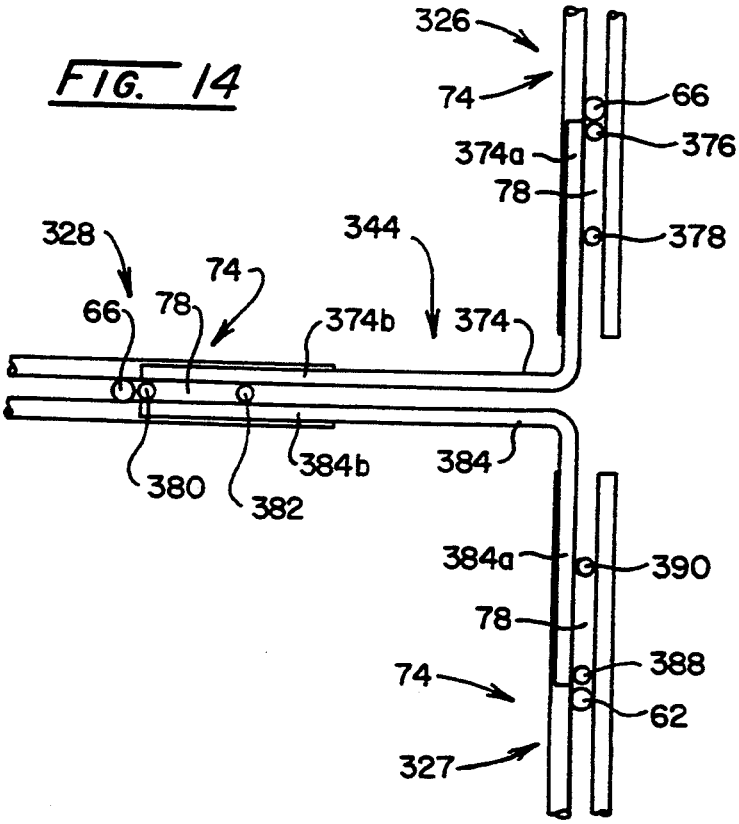
FIG. 14 is a top view of a modified corner link assembly which may be employed with the expanded rack assembly of FIG. 12.

Turning to FIG. 14, a top view representation of the modified corner link assembly 344 is revealed. Assembly 344 includes a plurality of horizontally disposed regularly vertically spaced corner link rods 374 having a first portion 374a which extend to a corner tab rod assembly including corner tab rods 376 and 378. Connection with these tab rods preferably is by resistance welding. Tab rods 376 and 378 are seen to be retained within the receptor gap 78 of the receiving connector assembly 74 of load receiving component 326. In this regard, note that vertical corner tab rod 376 is positioned in abutting parallel adjacency with vertical outwardly disposed loading rod 66 of the component 326. A second portion 374b extends an expanded distance perpendicularly to the first portion to a corner tab rod assembly including vertically disposed corner tab rods 380 and 382. Connection with these rods preferably is by resistance welding. Note that the rods 380 and 382 are retained within receptor slots 78 of receiving connector assembly 74 of the load receiving component 328. Corner tab rod 380 is seen to be in parallel abutting adjacency with outwardly disposed vertical loading rod 66 of the component 328.

A second plurality of horizontally disposed corner link rods is provided with the assembly 344 as represented at 384. A first portion as at 384a of these corner link rods extends to connection with a corner tab rod assembly including vertically disposed corner tab rods 388 and 390. Connection with the tab rods 388 and 390 preferably is by the noted resistance welding procedure. Rods 388 and 390 are retained within the receptor gap 78 of receiving connector assembly 74 of the load receiving unit 327. Note in this regard that corner tab rod 388 is positioned in parallel abutting adjacency with outwardly disposed vertical loading rod 62 of the component 327. The second and normally disposed portion of the horizontally disposed corner link rods 384 is provided as shown at 384b extending to connection with vertically disposed corner tab rods 380 and 382. As before, preferable connection is by resistance welding, and all rod components are of lesser cross sectinoal dimension, for example, 3/16 inch diameter.

The salient features of the above-described rack assembly may also be combined to provide a modular form of device which, inter alia, may be used to develop a "tower" form of rack architecture. Looking to FIG. 15, this tall and relatively compact assembly is represented generally at 400. The assembly 400 generally exhibits an outer frame represented generally at 412 which surmounts a interior region serving to support a sequence of shelves 414–417. For the embodiment shown, the frame 412 and associates shelves 414–417 are mounted upon a base assembly represented generally at 418 which incorporates four freely-rotatable wheels having caster configuration. Three of those wheels are shown at 420–422. In general, the outer frame 412 will have dimensions of about 18 inches square, and a height of about 4 feet. Because of its rigidity, it is readily pushed from place to place while shelves 414, 417 are fully loaded.

Outer frame 412 is fashioned from two identical open-frame modules, one of which is revealed at 430 in FIG. 16. Looking to that figure, the module 430 is seen to be formed of two open frame components represented generally at 432 and 434. Component 432 is formed having three, vertically oriented parallel and spaced apart loading rods 436–438. Rods 436–438, as before, may have a diameter, for example, of ¼ inch and function to carry load in compression to the base assembly 418 or a floor surface upon which they may be resting. Retaining the loading rods 436–438 in proper transversely spaced orientations to assure their verticality for load transfer are a plurality of horizontally disposed mutually parallel connector rods. As before, these connector rods are paired, regularly vertically spaced, mutually parallel, and preferably formed as parallelogramic loops. In this regard, the paired loading rods are shown in general at 440–443. The parallelogramic loops extend outwardly from the outermost loading rod 438 and form receiving connector assemblies defining receptor gaps shown, respectively, at 444–447 in the same manner as the earlier embodiments. Preferably, the connector rods of assemblies 440–443 mutually converge at the receptor gaps 444–447 to provide a gripping engagement of tab forming components that are inserted therein. The extent of these gaps 444–447 also is controlled by the parameters selected in the course of resistance welding the connector rods to the loading rods. This is controlled, for example, by regulating the amount of current, the length of welding interval, and pressure. In a preferred arrangement, for a loading rod cross-sectional diameter of ¼ inch, the cross-sectional diameter of the connector rods forming paired assemblies 440–443 is selected, as before, as about 3/16 of an inch.

Now looking to open frame receiving component 434, two vertically oriented loading rods 448 and 449 are provided which are spaced apart, preferably have diametric extent of ¼ inch, and function to carry load and compression to base region 418 or the surface upon which they sit. Loading rods 448 and 449 are retained in their spaced vertical orientations by a sequence of three link assemblies, each such assembly being seen formed of horizontal end link rods generally having a D-shaped configuration for each of the link assemblies 452–455. In this regard, assembly 452 is formed of horizontal end link rods 456 and 457; assembly 453 is formed of horizontal end link rods 458 and 459; and link assembly 454 is formed of horizontal end link rods 460 and 461. The vertical spacing of the horizontal end link rods forming the assemblies 452–455 is slightly greater than the corresponding vertical spacing of the connector rods forming the receiving connector assemblies at 440–443 to permit their eventual inter-nesting. The horizontal end link rods 456–463 serve to support vertically disposed tab rods 464 and 465 having a diameter or cross-sectional dimension, for example, of 3/16 of an inch making them suitable for slidable insertion within the receptor gaps 444–447 of open frame loading-receiving component 432.

Loading receiving components 432 and 434 are retained in a vertical, spaced-apart relationship as shown by a sequence of U-shaped horizontal cross members 470–473. Cross members 470–473 each having one side portion as shown, respectively, at 476–479 which is weldably attached to loading rods 436–438 of load receiving component 432. Correspondingly, the opposite side portions of cross members 470–473 as shown, respectively, at 482–485 are weldably connected to the loading rods 448 and 449 as well as tab rods 464 and 465 of load receiving component 434. Positioned between and extending normally from each of the side portions of the cross members 470–473 are intermediate portions shown, respectively, at 488–491 which define two corners with those side portions. Rigidity for the entire assemblage is enhanced by the provision of two corner rods 494 and 495. In this regard, corner rod 494 is spaced outwardly from loading rod 436 of load receiving component 432, while corner rod 495 is spaced outwardly from loading rod 448 of load receiving component 434. Corner rods 494 and 495 are welded at the corner locations, preferly with a fillet form of weld which further enhances rigidity of the module 430. Preferably, the corner rods 494 and 495 are of the same cross-sectional dimension as the loading rods, i.e. ¼ inch.

The horizontal cross members 470–473 are of open frame construction, each being formed of three horizontal support rods identified, for example, at 498–500 in connection with cross member 470; 501–503 in connection with cross member 471; 504–506 in connection with cross member 472; and 507–509 in connection with cross member 473.

Figure 19:
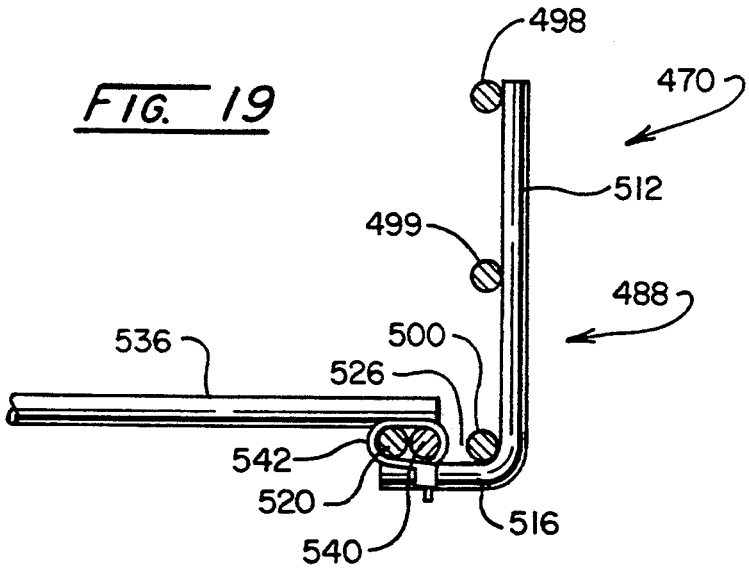
FIG. 19 is a partial side view of a shelf connecting arrangement of the apparatus of FIG. 15.

Looking additionally to FIG. 19, each of the cross members 470–473 further incorporates a shelf support assembly formed of a plurality of vertically oriented and mutually spaced apart spacer rods, certain of which are identified at 512–515 in connection with intermediate portions 488–491. As seen in FIG. 19 in connection with the inermediate portion 488 of cross member 470, each of the spacer rods 512 depends inwardly from connection with support rod 500 as at 516 to support a horizontally disposed capture rod 520. Such capture rods are shown in FIG. 16 at 520–523 in connection with respective intermediate portions 488–491. FIG. 19 reveals that capture rod 520, when considered in conjunction with the lowermost support rod 500, serves to define a capture gap 526 extending along intermediate portion 488.

Figure 15:
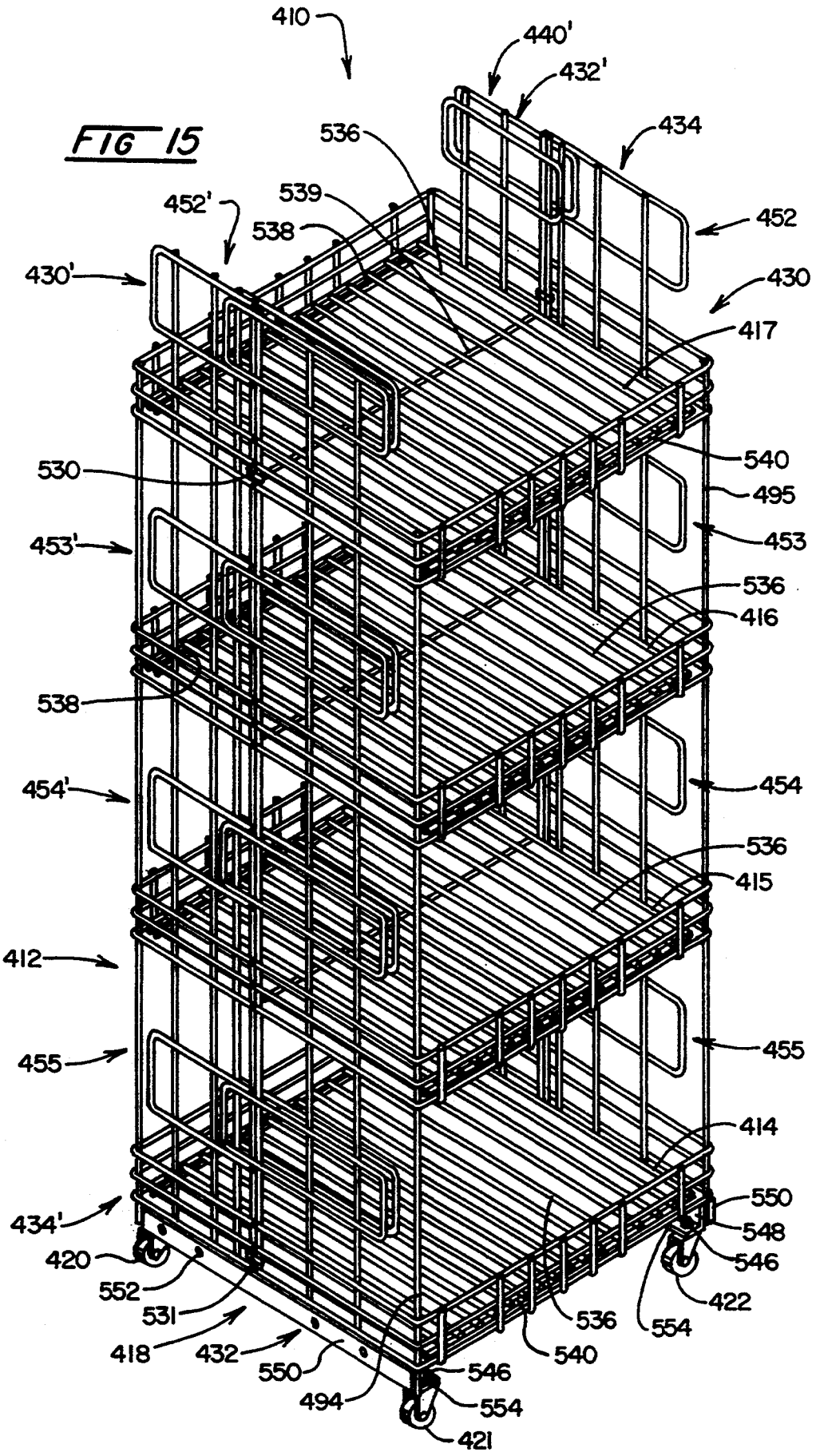
FIG. 15 is a perspective view of a rack assembly according to the invention configured with a tower architecture and having lower disposed wheels.

The assembly of two of the modules 430 to form the assembly 400 as seen in FIG. 15 is quite simple. In this regard, the tab rods 464, 465 extending within each of the link assemblies 452–455 are slidably inserted within the corresponding receptor gaps 444–447 of the corresponding receiving connecting assemblies at 440–443.

Figure 18:
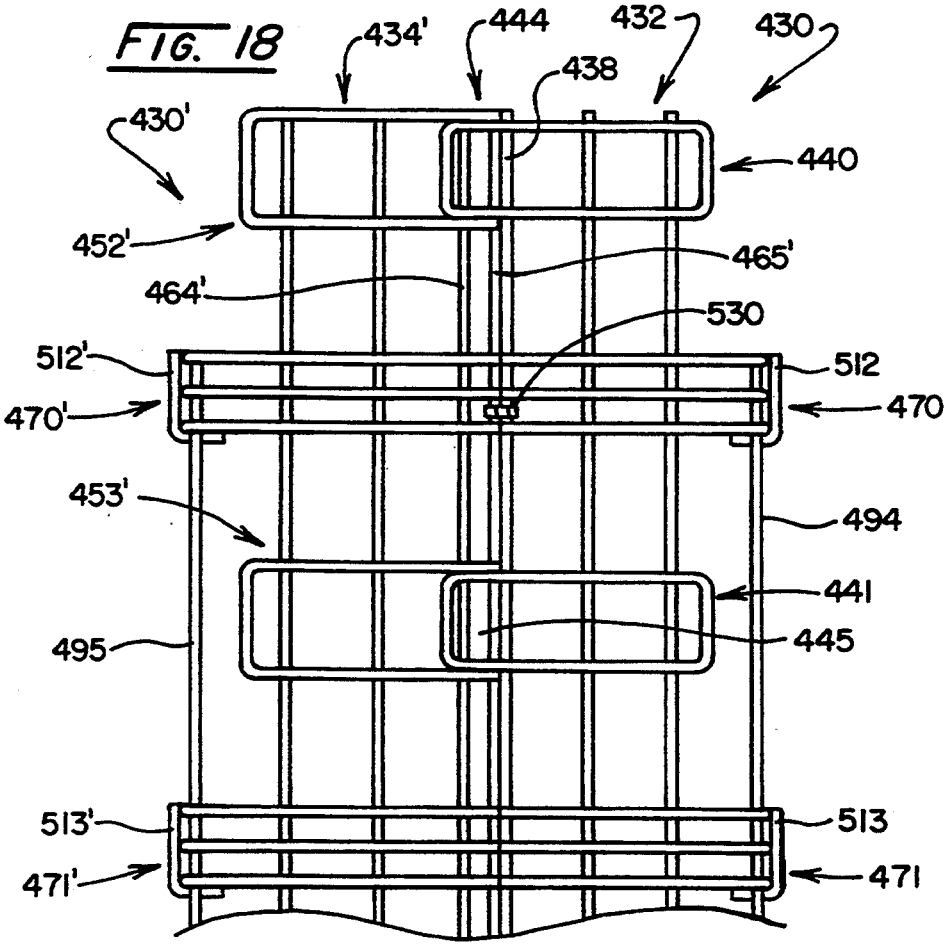
FIG. 18 is a partial side view of the assembly of FIG. 15.

Looking to FIG. 18, a portion of load receiving component 432 of module 430 is shown connected with a load receiving component of another module identical to module 430 and having identifying numeration the same as module 430 but shown in primed fashion. Thus, the load receiving component 432 of module 430 is seen connected with the load receiving component 430' of a module 430'. This same primed and unprimed identification of components is provided in FIG. 15 additionally. Thus, FIG. 18 shows that tab rods 464' and 465' as they extend within link assemblies 452' and 453' extend into the receptor gaps 444 and 445 of respective receiving connector assemblies 440 and 441. To assure the maintenance of the union of the two modules 430 and 430', only two small polymeric ties as at 528 and 530 (FIG. 15) are employed at this stage of assembly.

FIG. 18 also reveals that the widthwise extents of load receiving components 432 and 434 are different. As in the earlier embodiments, accommodation is made for the different diameters of a tab rod as at 465' with respect to an adjacent loading rod as at 438. Additionally, for the architecture of FIG. 15, where the assembly 400 is about 18 inches square, adjustment of the widthwise extents of the load receiving components is made to achieve an esthetic symmetry. In this regard, the widthwise extent, for example of component 434, is about 9¾ inchs from corner rod 495 to outer tab rod 465, while, correspondingly, the distance from corner rod 494 to loading rod 438 of component 432 is about 8¼ inches. Such dimensioning achieves the symmetry observable in connection with FIG. 15.

Figure 17:
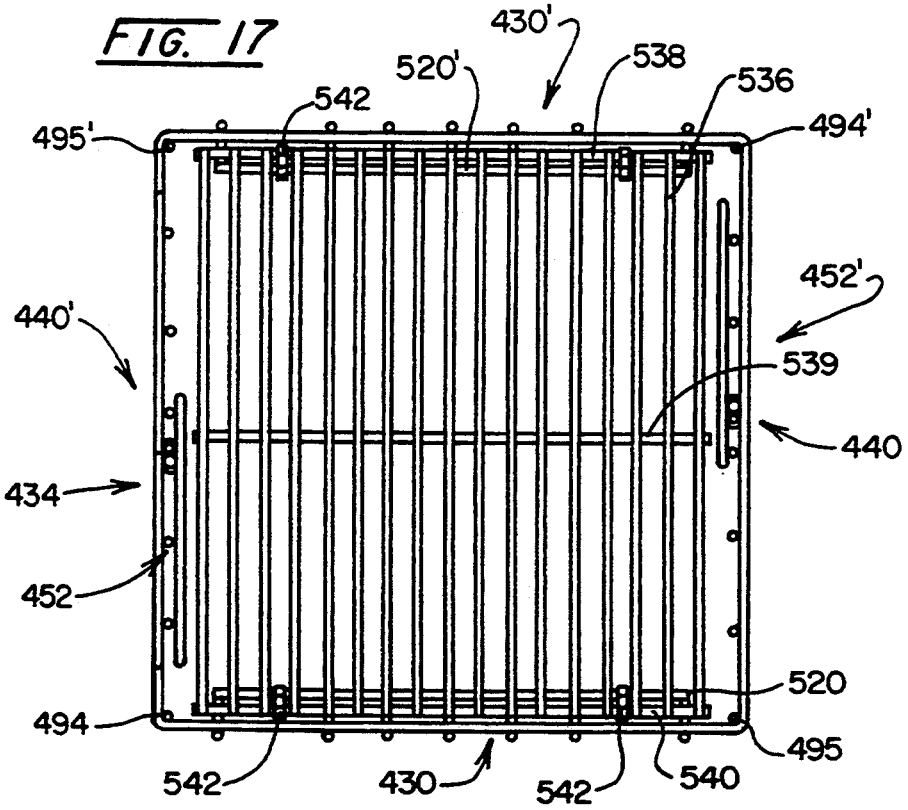
FIG. 17 is a top view of the assembly of FIG. 15.

Referring to FIGS. 15 and 17, the structures of the open frame shelves 414–417 are revealed. The shelves are formed of an array of upwardly disposed parallel shelf rods, certain of which are identified at 536. Each of the arrays of shelf rods 536 are welded to three downwardly disposed transverse rods, certain of which are shown at 538–540. Of these transverse rods, the outermost ones, 538 and 540, are at the end points of the shelf arrays 536 and nest, as shown in FIG. 17, within the capture gap 526 of the shelf support assemblies. Thus, the shelves 414–417 are secured in place and, additionally, promote the integrity of the assembly 400 by retaining the two modules 430 and 430' in appropriate connection. Preferably, one or more small polymeric ties as shown at 542 in FIG. 17 and 544 in FIG. 20 are provided to assure the retention of outermost transverse rods 540 within the capture gaps 526.

Figure 20:
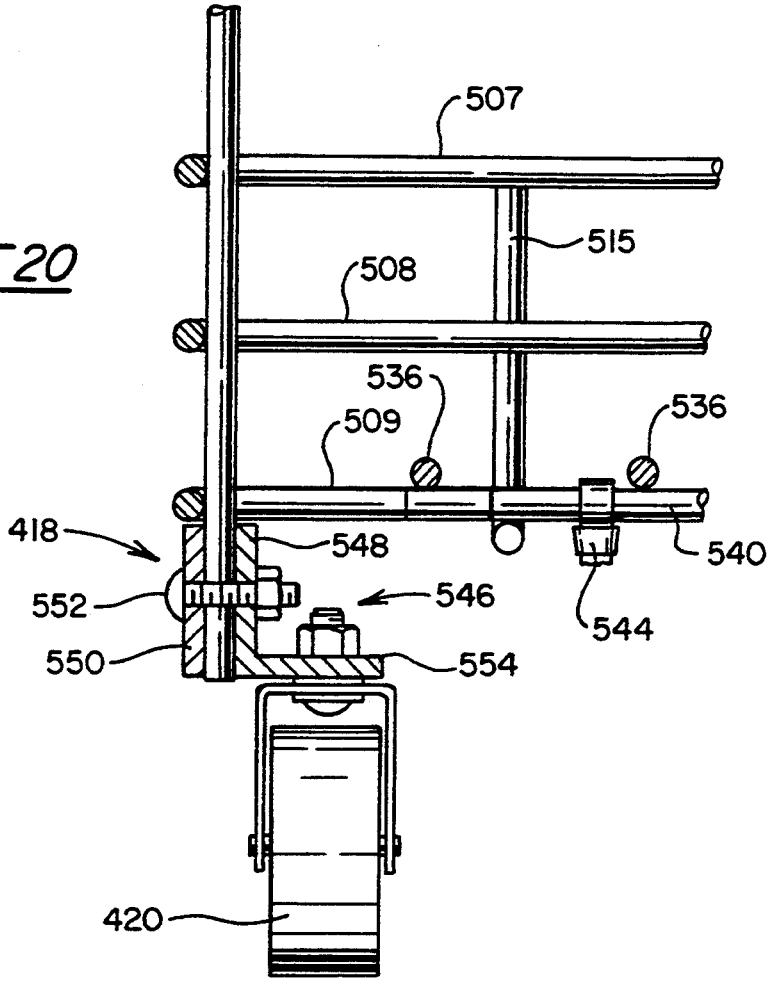
FIG. 20 is a partial sectional view of the lower portion of the assembly of FIG. 15 showing wheel mounting features.

Looking to FIGS. 15 and 20, the base assemblies at 418 are revealed. FIG. 20 shows that a base assembly 418 is formed of an angle iron 546, an upstanding flange 548 of which is bolted through the lower portion of each interconnected module to a strip strap 550. Thus, the lower portions of the load receiving assemblies are connected as at 432'–434 and 432–434'. Bolts and nut connections are shown, for example, at 552. A freely rotating and swivel mounted caster form of wheel as earlier-described at 420–422 is bolted to each horizontally disposed flange 554 of the angle irons 546.

Modules as described at 430 in FIG. 16 also may be employed to form space or room dividers which, in a retail environment, may hold products on hooks and the like. For this purpose, the modules 430 are configured without the uppermost link assemblies 452 or paired connector rod assemblies 440. Thus the top of the module 430 will be constructed in identical fashion as the bottom and alternating modules may be turned upside down to form the upstanding structure. This structure is shown in FIG. 21 in a top view showing a module 560 with paired connector rod assembly 562 coupled with the link assembly 564 of a module 566. In similar fashion, the paired connector rod assembly 568 of module 566 is coupled with the link assembly 570 of module 572. The modules thus joined evoke an extended assembly which incorporates a sequence of adjacent shelf access bag areas shown generally at 575. Load carrying shelves, not shown, can be mounted within the bags according to principles discussed with FIG. 17.

Since certain changes may be made in the above described system and apparatus without departing from the scope of the invention herein involved, it is intended that all matter contained in the description thereof or shown in the accompanying drawings shall be interpreted as illustrative and not in a limiting sense.

I claim:

1. An open frame module positionable upon a surface for connection with open frame components to form a vertically upstanding support for items, comprising:

a first open frame load receiving component having at least two parallel, spaced apart loading rods of first widthwise cross-sectional dimension, having a lower portion for transferring load to said surface and extending vertically upwardly a select height, having a plurality of receiving connector assemblies formed of horizontally disposed mutually parallel connector rods connected to an outwardly disposed said loading rod and extending outwardly therefrom a predetermined distance to define a receptor gap, said connector assemblies being positioned at spaced levels extending upwardly from the vicinity of said lower portion;

a second open frame load receiving component having two parallel, spaced apart loading rods of said first widthwise cross-sectional dimension, having a lower portion for transferring load to said surface and extending vertically upwardly a select height, having a plurality of link assemblies, each link assembly including at least one horizontal end link rod connected to and extending from one of said two loading rods and supporting at least one vertically disposed tab rod of second widthwise cross-sectional dimension less than said first widthwise cross-sectional dimension, said tab rod being slidably insertable within oppositely disposed said receptor gaps of another said module to a position of substantial parallel adjacency with a said loading rod thereof;

a U-shaped horizontal cross member having a first side portion connected to said first load receiving component, having a second side portion connected to said second load receiving component, and an intermediate portion of predetermined length extending normally from each said first and second side portion and defining respective first and second corners therewith, said cross member positioning said first and second load receiving components in vertical, spaced apart relationship corresponding with said predetermined length.

2. The open frame module of claim 1 in which said module includes first and second corner rods parallel to and spaced outwardly from said loading rods, positioned respectively at said first and second corners and fixed to said cross member.

3. The open frame module of claim 1 in which said module includes:

a plurality of said U-shaped cross members located in vertically spaced apart relationship; and first and second corner rods parallel to and spaced outwardly from said loading rods, positioned respectively at said first and second corners and weldably fixed to said cross members to form a gusset defining coupling.

4. The open frame module of claim 1 in which each of said receiving connector assemblies includes two, spaced apart said connector rods extending from said outwardly disposed loading rod to form parallel, adjacent loops having top and bottom comopnents vertically spaced apart a predetermined vertical loop dimension and defining said receptor gap at each said receiving connector assembly.

5. The open frame module of claim 4 in which each said link assembly includes two said end link rods spaced vertically apart a tab height, said tab height being greater than said vertical loop dimension.

6. The open frame module of claim 1 in which:

said receiving connector assemblies and said link assemblies are mutually oppositely disposed at common said spaced levels extending upwardly from the vicinity of said lower portion; and said module includes a plurality of said U-shaped horizontal cross members spaced vertically from said common spaced levels of said receiving connector assemblies and said link assemblies.

7. The open frame module of claim 1 in which said U-shaped horizontal cross member is of open frame configuration formed of at least two horizontal, vertically spaced support rods extending between said first and second corners to define said first and second corners and bent to extend therefrom to define respective said first and second side portions.

8. The open frame module of claim 1 in which said vertically disposed tab rod is spaced from said second corner a distance greater by an amount at least equivalent to said second widthwise cross-sectional dimension, than the corresponding spacing of said first open frame load receiving component outwardly disposed loading rod from said first corner.

9. A rack assembly positionable upon a floor for supporting load carrying shelves, comprising:

first and second interconnectable open frame modules each including:

a first open frame load receiving component having two parallel spaced apart loading rods of first widthwise cross sectional dimension, having a lower portion for transferring load to said floor and extending upwardly a select height, having a plurality of receiving connector assemblies formed of horizontally disposed mutually parallel connector rods connected to an outwardly disposed said loading rod and extending outwardly therefrom a predetermined distance to define a receptor gap, said connector assemblies being positioned at spaced levels extending upwardly from the vicinity of said lower portion, a second open frame load receiving component having two parallel, spaced apart loading rods of said first widthwise cross-sectional dimension, having a lower portion for transferring load to said floor and extending vertically upwardly a select height, having a plurality of link assemblies, each link assembly including at least one horizontal end link rod connected to and supported from one of said two loading rods and supporting at least one vertically disposed tab rod of second widthwise cross-sectional dimension less than said first widthwise cross-sectional dimension, and a U-shaped horizontal cross member having a first portion connected to said first load receiving component, having a second side portion connected to said second load receiving component and having an intermediate portion of predetermined length extending normally from each said first and second side portion and defining respective first and second corners therewith, said cross member positioning said first and second load receiving components in vertical, spaced apart relationship corresponding with said predetermined length;

said tab rods of said first and second modules being slidably insertable within oppositely disposed said receptor gaps of receiving connector assemblies of respective said second and first modules to a position of substantial parallel adjacency with a said outwardly disposed loading rod to connect said first module with said second module to form a vertically upstanding outer frame surmounting an internal region; and at least one shelf within said internal region supported by said outer frame.

10. The rack assembly of claim 9 in which said first and second modules include first and second corner rods located parallel to and spaced outwardly from said loading rods, positioned respectively at said first and second corners and fixed to said cross members.

11. The rack assembly of claim 9 including a base assembly connectable with said lower portion of said first and second load receiving components of said first and second modules when interconnected for receiving loads transferred therefrom, and including wheels depending downwardly therefrom for engaging said floor and providing rolling mobility for said assembly.

12. The rack assembly of claim 11 in which said base assembly includes two rigid base members each supporting two said wheels, each said base member being connected to one of the interconnected first and second open frame load receiving components of said first and second open frame modules, soa s to promote the security of said interconnection.

13. The rack assembly of claim 9 in which each said first and second module includes:

a plurality of said U-shaped cross members located in vertically spaced apart relationship; and first and second corner rods parallel to and spaced outwardly from said loading rods, positioned respectively at said first and second corners and weldably fixed to said cross members to form a gusset defining coupling.

14. The rack assembly of claim 9 in which said first and second modules are substantially identically configured.

15. The rack assembly of claim 9 in which said U-shaped horizontal cross member of said first and second modules is of open frame configuration formed of at least two horizontal, vertically spaced-support rods extending between said first and second corners to define said first and second corners and bent to extend therefrom to define respective said first and second side portions.

16. The rack assembly of claim 15 in which:

said U-shaped horizontal cross member of said first and second modules includes a shelf support assembly fixed to and extending horizontally inwardly within said internal region from a said support rod, and a capture rod fixed to said support assembly in parallel spaced apart relationship with said support rod to define a capture gap therebetween; and said shelf is of open frame configuration having an array of upwardly disposed shelf rods extending between two oppositely disposed, parallel and downwardly depending transverse rods spaced apart a distance selected for effecting their positioning within a said capture gap.

* * * * *